US007145535B2

(12) United States Patent
Takako et al.

(10) Patent No.: US 7,145,535 B2
(45) Date of Patent: Dec. 5, 2006

(54) LIQUID CRYSTAL DISPLAY DEVICE

(75) Inventors: Adachi Takako, Mie (JP); Shiomi Makoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 187 days.

(21) Appl. No.: 10/256,443

(22) Filed: Sep. 26, 2002

(65) Prior Publication Data

US 2003/0058264 A1 Mar. 27, 2003

(30) Foreign Application Priority Data

Sep. 26, 2001 (JP) ..... 2001-293401
Aug. 23, 2002 (JP) ..... 2002-244183

(51) Int. Cl.
*G09G 3/36* (2006.01)

(52) U.S. Cl. ..... 345/87; 345/88; 345/89; 345/96; 345/55

(58) Field of Classification Search ..... 345/38, 345/50, 55, 87–89, 95–97, 101
See application file for complete search history.

(56) References Cited

U.S. PATENT DOCUMENTS 5,557,434 A * 9/1996 Winker et al. ..... 349/117
5,680,148 A * 10/1997 Okada et al. ..... 345/95
6,057,901 A * 5/2000 Xu ..... 349/121
2001/0040546 A1* 11/2001 Ohmuro et al. ..... 345/87

FOREIGN PATENT DOCUMENTS

| | | | |
|---|---|---|---|
| JP | 64-10299 | | 1/1989 |
| JP | 04-288589 | | 10/1992 |
| JP | 10-186354 | * | 7/1998 |
| JP | 10-186355 | * | 7/1998 |
| JP | 10-253942 | | 9/1998 |
| JP | 2000-231091 | | 8/2000 |
| KR | 2001-55986 | | 7/2001 |

OTHER PUBLICATIONS

U.S. Appl. No. 09/632,878, filed Aug. 4, 2000.

* cited by examiner

*Primary Examiner*—Richard Hjerpe
*Assistant Examiner*—Leonid Shapiro
(74) *Attorney, Agent, or Firm*—Harness, Dickey & Pierce, P.L.C.

(57) ABSTRACT

A liquid crystal panel exhibits an extreme value of transmittance in the voltage-transmittance characteristic in response to a voltage that is equal to or greater than the highest gray level voltage. A driving circuit supplies, to the liquid crystal panel, a predetermined driving voltage that is obtained by overshooting a gray level voltage corresponding to an input image signal of the current vertical period according to a combination of an input image signal of the previous vertical period and the input image signal of the current vertical period.

12 Claims, 16 Drawing Sheets

LIQUID CRYSTAL DISPLAY DEVICE

BACKGROUND OF THE INVENTION

1. Field of the Invention

The present invention relates to a liquid crystal display device, and more particularly to a liquid crystal display device suitable for displaying a motion picture.

2. Description of the Background Art

Liquid crystal display devices have been used in personal computers, word processors, amusement devices, television sets, etc. Studies and researches have been made in order to further improve the response characteristic of liquid crystal display devices so as to realize a high-quality motion picture display.

Japanese Laid-Open Patent Publication No. 4-288589 discloses a liquid crystal display device in which the rise response speed and the fall response speed are increased by supplying input image signals, in which high frequency components have been emphasized in advance, to the liquid crystal display section, in order to increase the response speed in a gray level display so as to reduce the after-image. Note that the "response speed" of a liquid crystal display device (liquid crystal panel) corresponds to the inverse number of an amount of time (response time) that is required for bringing the liquid crystal layer into an orientation that corresponds to the applied voltage. A configuration of a driving circuit of the liquid crystal display device will be described with reference to FIG. 14.

The driving circuit of the liquid crystal display device includes an image memory circuit 61 for storing at least one field image of an input image signal S(t), and a time base filter circuit 63 for detecting a level change in the time base direction for each picture element from the image signal stored in the image memory circuit 61 and the input image signal S(t) and for providing high-frequency-emphasizing filtering in the time base direction. The input image signal S(t) is one of R, G and B signals obtained by dividing a video signal. Since the same process is performed for the R, G and B signals, only one channel is illustrated herein.

The input image signal S(t) is stored in the image memory circuit 61 for storing at least one field of image signal. A subtractor 62 obtains the difference between a picture element signal of the input image signal S(t) and that from the image memory circuit 61, and thus serves as a level change detection circuit for detecting a change in the signal level over one field. The difference signal Sd(t) in the time base direction obtained by the subtractor 62 is input to the time base filter circuit 63 together with the input image signal S(t).

The time base filter circuit 63 includes a weighting circuit 66 for multiplying the difference signal Sd(t) with a weighting coefficient $\alpha$ according to the response speed, and an adder 67 for adding the input image signal S(t) to the weighted difference signal. The time base filter circuit 63 is an adaptive filter circuit capable of changing its filter characteristics according to the output from the level change detection circuit and the input level for each picture element of the input image signal. The high frequency components of the input image signal S(t) are emphasized in the time base direction by the time base filter circuit 63.

The obtained signal in which the high frequency components have been emphasized is converted to an alternating current signal by a polarity inversion circuit 64 and is supplied to a liquid crystal display section 65. The liquid crystal display section 65 is an active matrix liquid crystal display section having a display electrode (referred to also as "picture element electrode") at each intersection between a plurality of data signal lines and a plurality of scanning signal lines extending perpendicular to the data signal lines.

FIG. 15 is a signal waveform diagram illustrating how the response characteristic is improved by the driving circuit. It is assumed that the input image signal S(t) changes at a cycle of one field for ease of understanding, and FIG. 15 shows a case where the signal level changes rapidly over two fields. In this case, the change in the input image signal S(t) in the time base direction is represented by the difference signal Sd(t), which takes a positive value for one field when the input image signal S(t) changes in the positive direction and takes a negative value for one field when the input image signal S(t) changes in the negative direction, as illustrated in FIG. 15.

Basically, the high frequency components can be emphasized by adding the difference signal Sd(t) to the input image signal S(t). In practice, since the relationship between the degree of change in the input image signal S(t) and that in the transmittance is dependent on the response speed of the liquid crystal layer, the weighting coefficient $\alpha$ is determined so that a correction can be made within a range such that an overshoot does not occur. As a result, a high frequency corrected signal Sc(t), in which the high frequency components have been emphasized, as illustrated in FIG. 15, is input to the liquid crystal display section. Therefore, it is possible to obtain an optical response characteristic I(t) (solid line), which is improved over that obtained by a conventional method (broken line).

Moreover, Japanese Laid-Open Patent Publication No. 2000-231091 discloses that in a case where a pixel is to be brought to a greater transmittance in a liquid crystal display device in which the liquid crystal molecules are aligned substantially vertically in the absence of an applied voltage, it is possible to reduce the response time for a transition from a black display to a low-brightness intermediate gray level display by applying a voltage that is greater than a target driving voltage to the pixel electrode.

There is a demand for a liquid crystal display device in which liquid crystal molecules respond quickly to an applied voltage. It is known in the art to employ a double-speed driving method or a backlight impulse driving method in order to obtain a high quality motion picture display with no blurredness. In order to effectively perform these driving methods, it is of course required for the liquid crystal layer to respond within one field, and it may also be required to realize a higher response speed as those achieved by the liquid crystal display devices described in the above publications.

The present invention has been made in view of the above, and has an object to provide a liquid crystal display device in which the rising response characteristic is further improved.

The term "rise" as used herein refers to a change in the display state (or the orientation of the liquid crystal layer) in response to an "increase" in the voltage applied across the liquid crystal layer. Thus, a "rise" is a change in response to an increase in the applied voltage, and corresponds to an "increase in brightness" in a normally black mode (hereinafter referred to as "NB mode") and to a "decrease in brightness" in a normally white mode (hereinafter referred to as "NW mode"). In other words, a "rise" is associated with the orientation of the liquid crystal layer (liquid crystal molecules) being brought under tension.

SUMMARY OF THE INVENTION

According to the first aspect of the present invention, a liquid crystal display device includes: a liquid crystal panel including a liquid crystal layer and an electrode for applying a voltage across the liquid crystal layer; and a driving circuit for supplying a driving voltage to the liquid crystal panel, wherein: the liquid crystal panel exhibits an extreme value of transmittance in a voltage-transmittance characteristic in response to a voltage that is equal to or greater than a highest gray level voltage; and the driving circuit supplies, to the liquid crystal panel, a predetermined driving voltage that is obtained by overshooting a gray level voltage corresponding to an input image signal of a current vertical period according to a combination of an input image signal of a previous vertical period and the input image signal of the current vertical period. Thus, the object set forth above is achieved.

It is preferred that the input image signal of the previous vertical period is processed according to an estimate value of transmittance of the liquid crystal panel in the previous vertical period.

According to the second aspect of the present invention, a liquid crystal display device includes: a liquid crystal panel including a liquid crystal layer and an electrode for applying a voltage across the liquid crystal layer; and a driving circuit for supplying a driving voltage to the liquid crystal panel, wherein: the liquid crystal panel exhibits an extreme value of transmittance in a voltage-transmittance characteristic in response to a voltage that is equal to or greater than a highest gray level voltage; and the driving circuit supplies, to the liquid crystal panel, a predetermined driving voltage that is obtained by overshooting a gray level voltage corresponding to an input image signal of a current vertical period according to a combination of an estimate signal corresponding to an estimate value of transmittance of the liquid crystal panel in a previous vertical period and the input image signal of the current vertical period.

The estimate signal in the previous vertical period may be predetermined according to a combination of an estimate signal, which has been processed according to an estimate value of transmittance of the liquid crystal panel in a vertical period preceding the previous vertical period, and an input image signal of the previous vertical period.

It is preferred that the estimate signal in the previous vertical period corresponds to a transmittance of the liquid crystal panel in the current vertical period.

It is preferred that a difference between a retardation of the liquid crystal panel under application of no voltage and that under application of a maximum voltage that can be applied across the liquid crystal panel is 280 nm or more.

It is preferred that the liquid crystal panel takes a retardation value of 260 nm or more in response to a voltage that is equal to or greater than a highest gray level voltage and is less than or equal to a maximum voltage that can be applied across the liquid crystal panel.

It is preferred that the liquid crystal panel is a transmission-type liquid crystal panel and the extreme value gives a maximum value of transmittance.

The driving circuit may supply, to the liquid crystal panel, a driving voltage that is obtained by overshooting a gray level voltage corresponding to an input image signal of a current field, at least in first one of at least two fields of the driving voltage, the at least two fields of the driving voltage corresponding to one frame of the input image signal, and the one frame being one vertical period of the input image signal.

It is preferred that the liquid crystal layer is a vertical-alignment-type liquid crystal layer.

The liquid crystal panel may further include a phase difference compensator; and the phase difference compensator may have a refractive index ellipsoid whose three principal refractive indices na, nb and nc are in a relationship of na=nb>nc, and be arranged so as to at least partially cancel a retardation of the liquid crystal layer.

The liquid crystal panel may further include a phase difference compensator; and the phase difference compensator may have a refractive index ellipsoid whose three principal refractive indices na, nb and nc are are in relationships of na>nc and nb>nc, and be arranged so as to at least partially cancel a retardation of the liquid crystal layer.

Functions of the present invention will now be described.

The liquid crystal panel included in the liquid crystal display device of the present invention exhibits an extreme value of transmittance in the voltage-transmittance characteristic in response to a voltage that is equal to or greater than the highest gray level voltage, and an overshot gray level voltage is applied across the liquid crystal panel. Note that while a liquid crystal display device is typically driven by using an alternating current, the voltage-transmittance characteristic represents the relationship between the absolute value of the voltage applied across the liquid crystal layer and the transmittance based on the potential at the counter electrode.

In the present specification, a voltage applied across the liquid crystal layer for displaying an image on the liquid crystal display device is referred to as "gray level voltage Vg". For example, in a case where an image is displayed with a total of 64 different gray levels from a gray level 0 (black) to a gray level 63 (white), a gray level voltage Vg that is used for a display at the gray level 0 is denoted as "V0", while a gray level voltage Vg that is used for a display at the gray level 63 is denoted as "V63". In the case of an NB-mode liquid crystal display device as illustrated in embodiments of the present invention, V0 is the lowest gray level voltage and V63 is the highest gray level voltage. Conversely, in the case of an NW-mode liquid crystal display device, V0 is the highest gray level voltage and V63 is the lowest gray level voltage.

In the following description, a signal representing an image to be displayed on the liquid crystal display device is referred to as "input image signal S", and a voltage that is applied to a picture element according to the input image signal S is referred to as "gray level voltage Vg". The input image signals of 64 different levels (S0 to S63) correspond to the gray level voltages (V0 to V63 ), respectively. The gray level voltages Vg are set so that the liquid crystal layer under application of a gray level voltage Vg exhibits a transmittance (display state) that is associated with an input image signal S corresponding to the gray level voltage Vg when the liquid crystal layer reaches a steady state. The transmittance is referred to as "steady transmittance". Of course, the values of the gray level voltages V0 to V63 may vary depending on the particular liquid crystal display device to be used.

The liquid crystal display device is driven in an interlaced mode, for example, wherein one frame of image is divided into two fields, and a gray level voltage Vg corresponding to an input image signal S is applied to the display section in each field. Of course, each frame may be divided into three or more fields, and the liquid crystal display device may be driven in a non-interlaced mode. In the case of a non-interlaced mode, a gray level voltage Vg corresponding to an input image signal S is applied to the display section in each frame. "One vertical period" as used herein refers to one field in the case of an interlaced mode and to one frame in the case of a non-interlaced mode.

An "overshot voltage" as used herein is determined based on a comparison between the input image signal S of the previous vertical period (the vertical period immediately before the current vertical period) and the input image signal S of the current vertical period. Specifically, an overshot voltage is a voltage that is higher than a gray level voltage Vg corresponding to the input image signal S of the current vertical period in a case where the gray level voltage Vg corresponding to the input image signal S of the current vertical period is higher than the gray level voltage Vg corresponding to the input image signal S of the previous vertical period, and is a voltage that is lower than a gray level voltage Vg corresponding to the input image signal S of the current vertical period in a case where the gray level voltage Vg corresponding to the input image signal S of the current vertical period is lower than the gray level voltage Vg corresponding to the input image signal S of the previous vertical period.

The comparison between the input image signal S of the previous vertical period and the input image signal S of the current vertical period for detecting an overshot voltage is performed for each picture element. Also in the case of an interlaced mode, in which one frame of image information is divided into a plurality of fields, the input image signal S for a particular picture element in the previous frame and the input image signals S from adjacent lines are used as interpolation signals, and these signals for all picture elements are obtained in one vertical period. Then, these input image signals S of the previous field are compared with those of the current field.

The difference between the overshot gray level voltage Vg and the predetermined gray level voltage (the gray level voltage corresponding to the input image signal S of the current vertical period) Vg may be referred to also as "overshoot amount". Moreover, an overshot gray level voltage Vg may be referred to also as "overshoot voltage". An overshoot voltage obtained for a predetermined gray level voltage Vg may be either another gray level voltage Vg that has a predetermined overshoot amount with respect to the predetermined gray level voltage Vg, or one of overshoot driving voltages that are separately provided for overshoot driving. At least one high-voltage side overshoot driving voltage and one low-voltage side overshoot driving voltage are provided for overshooting the highest gray level voltage (one of the gray level voltages having the highest voltage value) and the lowest gray level voltage (one of the gray level voltages having the lowest voltage value).

The liquid crystal panel of the liquid crystal display device of the present invention exhibits an extreme value of transmittance in the V-T characteristic in response to a voltage that is equal to or greater than the highest gray level voltage.

In a case where the liquid crystal panel exhibits an extreme value of transmittance in response to the highest gray level voltage, if a voltage that is obtained by overshooting the highest gray level voltage (i.e., the high-voltage side overshoot driving voltage) is applied, the transmittance once reaches a value that corresponds to the highest gray level voltage (which is the maximum value among the transmittance values used for display and is an extreme value of transmittance in the case of the NB mode, and is the minimum value among the transmittance values used for display and is an extreme value of transmittance in the case of the NW mode) and then reaches a value that corresponds to the overshoot voltage (which is a lower transmittance in the case of the NB mode, and is a higher transmittance in the case of the NW mode).

In a case where the highest gray level voltage is set to be lower than the voltage at which the transmittance takes an extreme value, if the voltage obtained by overshooting the highest gray level voltage (i.e., the high-voltage side overshoot driving voltage) is set to be higher than the voltage at which the transmittance takes an extreme value and is applied, the transmittance once reaches a value that corresponds to the highest gray level voltage (which is the maximum value among the transmittance values used for display in the case of the NB mode, and is the minimum value among the transmittance values used for display in the case of the NW mode) and then reaches a value that corresponds to the overshoot voltage (which is a lower transmittance in the case of the NB mode, and is a higher transmittance in the case of the NW mode).

In the case where the highest gray level voltage is set to be lower than the voltage at which the transmittance takes an extreme value, if the voltage obtained by overshooting the highest gray level voltage (i.e., the high-voltage side overshoot driving voltage) is set to be less than or equal to the voltage at which the transmittance takes an extreme value and is applied, the transmittance once reaches a value that corresponds to the highest gray level voltage (which is the maximum value among the transmittance values used for display in the case of the NB mode, and is the minimum value among the transmittance values used for display in the case of the NW mode) and then reaches a value that corresponds to the overshoot voltage (which is a higher transmittance in the case of the NB mode, and is a lower transmittance in the case of the NW mode).

The response time required for a rise (i.e., the amount of time required for reaching a steady state) is determined by the applied voltage. For two liquid crystal panels that use different liquid crystal materials having the same dielectric anisotropy ($\Delta\in$), the same viscosity and the same liquid crystal layer thickness with different refractive index anisotropies, the amount of time required for the liquid crystal molecules to respond is the same, with the applied voltage being equal. However, the liquid crystal panels take different transmittance values because they use different liquid crystal materials having different refractive index anisotropies and thus have different retardations. Particularly, in a case where the transmittance has an extreme value (which is a local maximum value in the case of the NB mode, and is a local minimum value in the case of the NW mode), the transmittance rapidly changes over time (see FIG. 1).

Therefore, according to the present invention, the rising response characteristic of a liquid crystal display device can be improved over that obtained by a conventional overshoot driving operation. Note that even when using a liquid crystal panel that does not exhibit an extreme value of transmittance on the high voltage side, the rising response characteristic can be improved by setting the highest gray level voltage to be slightly lower than the voltage at which the transmittance takes the maximum (in the NB mode) or minimum (in the NW mode) value. However, this will narrow the range of transmittance values available for display by the amount by which the highest gray level voltage is lowered. In contrast, in the liquid crystal display device of the present invention, the highest gray level voltage is set to be less than or equal to the voltage at which the transmittance takes an extreme value (which is a local maximum value in the NB mode, and is a local minimum value in the NW mode), whereby it is possible to improve the rising response speed while suppressing or preventing the loss of transmittance.

Particularly, in a case where the highest gray level voltage is set to be the voltage at which the transmittance exhibits an extreme value, there is no loss of transmittance. Moreover, in order to increase the effect of improving the response speed, it is preferred that the high-voltage side overshoot driving voltage is set to be higher than the voltage at which the transmittance exhibits an extreme value so that the change over time of the transmittance becomes more rapid.

Note that a liquid crystal panel that exhibits an extreme value of transmittance in the V-T characteristic in response to a voltage that is equal to or greater than the highest gray level voltage can be realized by adjusting the retardation thereof, for example.

An extreme value of transmittance is observed in the V-T characteristic by adjusting the retardation so that the difference between the retardation value of the liquid crystal panel under application of no voltage and that under application of the maximum voltage that can be applied across the liquid crystal panel is 280 nm or more. Alternatively, an extreme value of transmittance is observed in the V-T characteristic if the liquid crystal panel takes a retardation value of 260 nm or more in response to a voltage that is equal to or greater than the highest gray level voltage and less than or equal to the maximum voltage that can be applied across the liquid crystal panel.

In the present specification, "the retardation of a liquid crystal panel" means, unless otherwise stated, the sum of the retardation of the liquid crystal layer and the retardation of the phase difference compensator under application of the maximum voltage that can be used for display (e.g., 5.7 V) in the case of the NB mode, and is the retardation for light that is vertically incident on the display surface of the liquid crystal panel (parallel to the surface plane of the liquid crystal layer). Of course, if no phase difference compensator is provided, the retardation of the liquid crystal panel is the retardation of the liquid crystal layer under application of the maximum voltage that can be used for display (e.g., 5.7 V). Moreover, in the case of the NW mode, "the retardation of a liquid crystal panel" means, unless otherwise stated, the sum of the retardation of the liquid crystal layer and the retardation of the phase difference compensator in the absence of an applied voltage, and is the retardation for light that is vertically incident on the display surface of the liquid crystal panel. Of course, if no phase difference compensator is provided, the retardation of the liquid crystal panel is the retardation of the liquid crystal layer in the absence of an applied voltage. The retardation of a liquid crystal layer is the difference ($\Delta n$) between the maximum refractive index of the material and the minimum refractive index thereof times the thickness (d) of the liquid crystal layer.

Typically, the retardation of a transmission-type liquid crystal panel is set so that the retardation changes by about 260 nm by applying the gray level voltages. In other words, it is set so that the difference between the retardation of the liquid crystal panel in a lowest gray level display state and that in a highest gray level display state is about 260 nm. The retardation is determined so that the contrast ratio is high for green light (wavelength: about 550 nm), to which human eyes are most sensitive, and in view of a display characteristic (viewing angle dependence) for light of other colors. The retardation is set in the range of about 250 nm to about 270 nm depending on the specifications of the liquid crystal display device. In the following description, "about 260 nm" is used as a value that represents the set retardation value.

The present invention can be used more suitably with a vertical-alignment-type NB-mode liquid crystal display device than with a horizontal-alignment-type NB-mode liquid crystal display device. This is because one feature of the present invention is to increase the retardation of a liquid crystal panel. One way to increase the retardation of a liquid crystal panel is to increase the cell gap. However, this is not preferred as it will reduce the response speed of the liquid crystal molecules. Another way is to increase the difference in retardation due to cell gap variations in the panel plane by increasing the difference ($\Delta n$) between the maximum refractive index of the liquid crystal material and the minimum refractive index thereof In the case of a horizontal-alignment-type NB-mode liquid crystal display device, as the applied voltage increases, the retardation of the liquid crystal layer decreases, but the retardation of the liquid crystal panel as a whole increases due to the presence of a compensation film. Thus, this is not preferred as it will increase the retardation of the liquid crystal layer in a black display, whereby a non-uniformity (in-plane brightness non-uniformity) is likely to be observed. In contrast, in the case of a vertical-alignment-type NB-mode liquid crystal display device, the retardation of the liquid crystal layer and that of the liquid crystal panel both increase as the applied voltage increases. Therefore, the retardation is low in a black display, whereby a non-uniformity is less likely to be observed. Thus, it is possible to obtain a liquid crystal display device that is more suitable for AV applications, in which a pixel defect is unlikely to be observed and which can display a motion picture with a high image quality.

The NW mode presents problems to be described below. Therefore, in order to obtain a liquid crystal panel of a higher quality, it is preferred that the present invention is used with an NB-mode liquid crystal panel, which is free of such problems.

First, an NW-mode liquid crystal panel including a vertical-alignment-type liquid crystal layer presents problems such as coloring in a white display, and a decrease in the viewing angle. Therefore, it is not preferred to use a vertical-alignment-type liquid crystal layer in an NW-mode liquid crystal panel. In a case where a vertical-alignment-type liquid crystal layer is used in an NW-mode liquid crystal panel, it is necessary to apply a high voltage for obtaining a sufficient contrast. Alternatively, in order to obtain a sufficient contrast without applying a high voltage, it is necessary to use a phase difference compensation film having a large retardation value, whereby a display non-uniformity is likely to be observed.

On the other hand, with an NW-mode liquid crystal panel including a horizontal-alignment-type liquid crystal layer, as illustrated in FIG. 7, the viewing angle compensation is difficult. Therefore, it is also not preferred to use a horizontal-alignment-type liquid crystal layer in an NW-mode liquid crystal panel. In a case where a horizontal-alignment-type liquid crystal layer is used in an NW-mode liquid crystal panel, it is necessary to apply a high voltage for viewing angle compensation. Alternatively, in order to realize viewing angle compensation without applying a high voltage, it is necessary to use a phase difference compensation film, whereby a display non-uniformity is likely to be observed.

Note however that even in a case where the present invention is used with an NW-mode liquid crystal panel including a vertical-alignment-type liquid crystal layer or a horizontal-alignment-type liquid crystal layer, the rising response characteristic can be improved. Therefore, the description above is not to exclude the use of the liquid crystal display device of the present invention with such NW-mode liquid crystal panels.

DETAILED DESCRIPTION OF THE PREFERRED EMBODIMENTS

A liquid crystal display device of one embodiment of the present invention will now be described with reference to the drawings. Although the embodiment of the present invention will be described below with an example of a vertical-alignment-type NB-mode liquid crystal display device, the present invention is not limited thereto.

Retardation

An NB-mode liquid crystal panel provided in the liquid crystal display device of the present embodiment has a retardation that is adjusted so as to exhibit, in its V-T characteristic, a local maximum value (which is also the maximum value) of transmittance in response to a voltage that is equal to or greater than the highest gray level voltage.

Specifically, the retardation is adjusted so that the difference between the retardation value of the liquid crystal panel under application of no voltage and that under the maximum voltage that can be applied across the liquid crystal panel is 280 nm or more. Alternatively, the retardation is adjusted so that the liquid crystal panel takes a retardation value of 260 nm or more in response to a voltage that is equal to or greater than the highest gray level voltage and is less than or equal to the maximum voltage that can be applied across the liquid crystal panel.

Using liquid crystal display devices whose retardation values at 5.7 V have been adjusted, the reason for setting the retardation value in the present invention as described above will be described.

The retardation is the difference ($\Delta n$) between the maximum refractive index of the liquid crystal material and the minimum refractive index thereof times the thickness (d) of the liquid crystal layer. Typically, the transmittance of the liquid crystal layer is highest when the retardation is around 260 nm.

Figure 1:
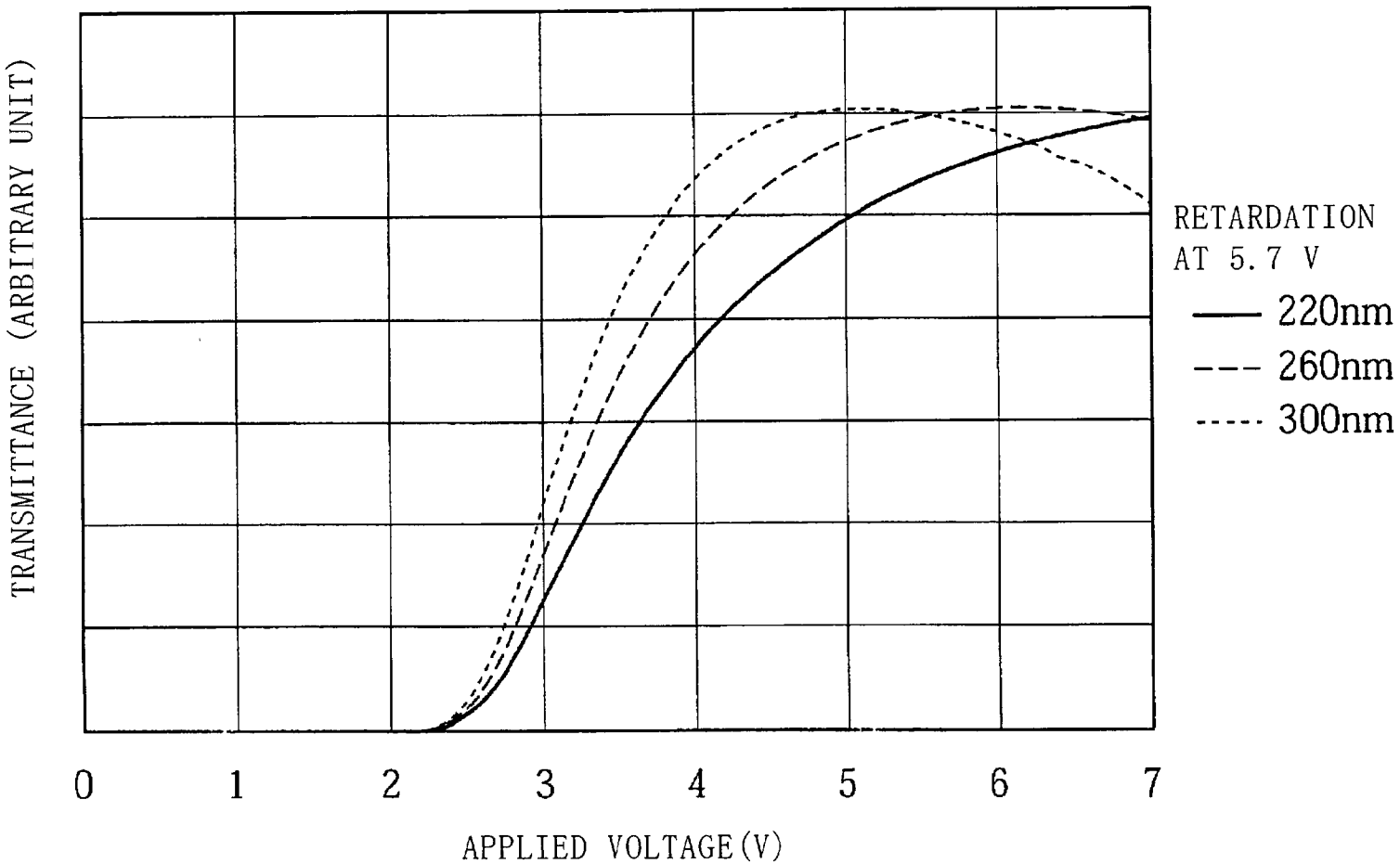
FIG. 1 is a graph illustrating V-T curves of liquid crystal panels having a vertical alignment layer.
Figure 2:
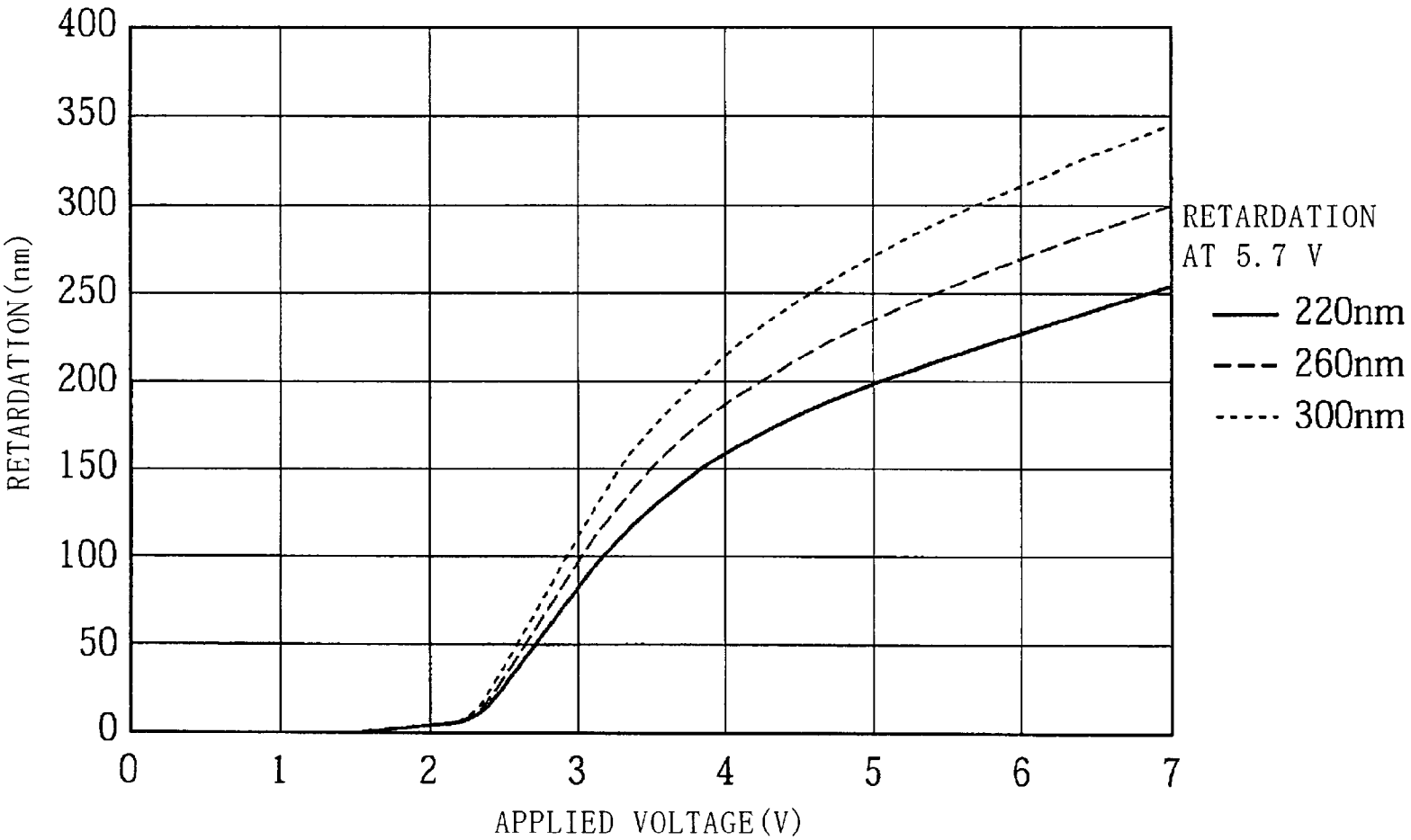
FIG. 2 is a graph illustrating voltage-retardation curves of liquid crystal panels having respective retardations of 220 nm, 260 nm and 300 nm.

FIG. 1 and FIG. 2 illustrate voltage-transmittance (V-T) curves and voltage-retardation curves, respectively, for devices whose retardation values are 220 nm, 260 nm and 300 nm at an applied voltage of 5.7 V. The vertical axis of each graph showing curves of transmittance or retardation, which changes according to the applied voltage, represents a relative value (arbitrary unit) with zero being the lowest value of transmittance or retardation. Therefore, the transmittance or retardation shown in the graph of FIG. 1 represents the amount of change in response to a change in the applied voltage.

In a case where the retardation is about 0 nm in the absence of an applied voltage and around 260 nm at an applied voltage of 5.7 V, the transmittance gradually increases as the applied voltage increases from zero. In a case where the retardation at an applied voltage of 5.7 V is 280 nm, the transmittance gradually increases as the applied voltage increases from zero, and takes a local maximum value at a retardation around 260 nm.

This principle will now be described. The typical liquid crystal display devices used herein include a liquid crystal material having a negative dielectric anisotropy and a vertical alignment film. In the absence of an applied voltage, the liquid crystal molecules are aligned substantially vertical to the glass substrate. By a voltage application, the orientation of the liquid crystal molecules gradually becomes more parallel to the glass substrate, thereby increasing the retardation. Typically, a highest transmittance occurs when the retardation is 250 nm to 270 nm (around 260 nm). Therefore, in a case where the retardation at an applied voltage of 5.7 V is around 260 nm or less, as the applied voltage is gradually increased from zero, the steady transmittance continues to increase while the applied voltage is 0 V to 5.7 V. When the applied voltage exceeds 5.7 V and the retardation takes a value around 270 nm, the transmittance exhibits an extreme value. For example, as illustrated in FIG. 1 and FIG. 2, in a case where the retardation at an applied voltage of 5.7 V is 260 nm, the retardation takes a value around 270 nm (see FIG. 2) and the transmittance takes a local maximum value (see FIG. 1) when the applied voltage is about 6 V. However, the maximum voltage that can be applied across a normal liquid crystal panel is about 7 V due to the withstand voltage of the circuit. Therefore, with a liquid crystal panel that exhibits an extreme value when the applied voltage is greater than 5.7 V, it is unlikely that an extreme value of transmittance is observed in the range of 0 V to 7 V.

On the other hand, in a case where the retardation at an applied voltage of 5.7 V is 300 nm or more, when the applied voltage is gradually increased from zero, the retardation comes close to 260 nm, and the steady transmittance takes a local maximum value. The applied voltage at this point is of course lower than 5.7 V. For example, as illustrated in FIG. 1 and FIG. 2, in a case where the retardation at an applied voltage of 5.7 V is 300 nm, the retardation takes a value around 260 nm (see FIG. 2) and the transmittance takes a local maximum value (see FIG. 1) when the applied voltage is about 5 V.

As can be seen from FIG. 1, in the present invention, the retardation is set to be 300 nm or more at an applied voltage of 5.7 V, whereby the transmittance exhibits an extreme value (i.e., a local maximum value in the NB mode, or a local minimum value in the NW mode) at a voltage less than or equal to 7 V, thus realizing an effective overshoot on the high voltage side. A device whose retardation at an applied voltage of 5.7 V is 300 nm is used in FIG. 1 and FIG. 2 for a better contrast to other devices. In practice, however, even with a device whose retardation at an applied voltage of 5.7 V is 280 nm, the transmittance exhibits an extreme value at a voltage less than or equal to 7 V, thus realizing an effective overshoot on the high voltage side. Thus, an extreme value of transmittance is observed in a V-T curve as long as the maximum retardation value of the liquid crystal panel is 280 nm or more. Therefore, the retardation can be set so that it takes a value of 280 nm or more in response to the maximum voltage that can be applied across the liquid crystal panel. Moreover, an extreme value of transmittance is observed in a V-T curve also in a case where the liquid crystal panel takes a retardation value of 260 nm or more in response to a voltage that is equal to or greater than the highest gray level voltage and is less than or equal to the maximum voltage that can be applied across the liquid crystal panel. Therefore, the retardation value can be adjusted to be 260 nm or more, preferably 270 nm or more, and more preferably 280 nm or more.

The retardation can be adjusted by changing the thickness of the liquid crystal layer (cell gap) or by employing a liquid crystal material of having a different Δn value. Alternatively, the retardation value may be adjusted by using a phase plate so that the retardation of the liquid crystal layer is canceled by the front retardation of the phase plate. The phase plate may be a phase plate in which the principle refractive index direction of the refractive index ellipsoid is inclined with respect to the direction normal to the surface of the phase plate. Note that it is not preferred to increase the thickness of the liquid crystal layer, as it lowers the response speed.

Overshoot Driving Voltage and Gray Level Voltage

In the case of the NB mode, the highest value of the gray level voltage Vg of the liquid crystal display device of the present invention is set to be less than or equal to the voltage at which the steady transmittance is highest. Moreover, the lowest value of the gray level voltage Vg is set to be equal to or greater than the voltage at which the steady transmittance is lowest. Note that in the case of the NW mode; the highest value of the gray level voltage Vg is set to be less than or equal to the voltage at which the steady transmittance is lowest, whereas the lowest value of the gray level voltage Vg is set to be equal to or greater than the voltage at which the steady transmittance is highest.

The liquid crystal display device of the present invention has a retardation difference of 280 nm or more, for example. Therefore, the voltage at which the transmittance is highest in the V-T curve of the NB-mode display device is the voltage that gives an extreme value, as illustrated in FIG. 1. Therefore, if the range of the gray level voltage Vg is set to include a voltage that is higher than the voltage that gives an extreme value, a transmittance inversion occurs, whereby a gray level inversion is observed. In order to prevent the gray level inversion, the highest gray level voltage is set to be less than or equal to the voltage that gives an extreme value. Note that the highest value of the gray level voltage Vg is of course set so as not to exceed the withstand voltage of the driving circuit (a driver, typically a driver IC).

In the liquid crystal display device of the present invention, overshoot driving voltages Vos are set in advance, separately from the gray level voltages Vg (V0 to V63). The overshoot driving voltages Vos include Vos(L) that is on the lower voltage side with respect to the gray level voltage Vg and Vos(H) that is on the higher voltage side with respect to the gray level voltage Vg. Each of Vos(L) and Vos(H) may be a single voltage value or may include a plurality of different voltage values. The high-voltage side overshoot driving voltage Vos(H) (the highest one if there are a plurality of high-voltage side overshoot driving voltages) is set so as not to exceed the withstand voltage of the driving circuit. Furthermore, the overshoot driving voltages Vos are set so that the number of overshoot driving voltages Vos plus the number of gray level voltages Vg (V0 to V63) do not exceed the number of bits of the driving circuit.

Figure 3:
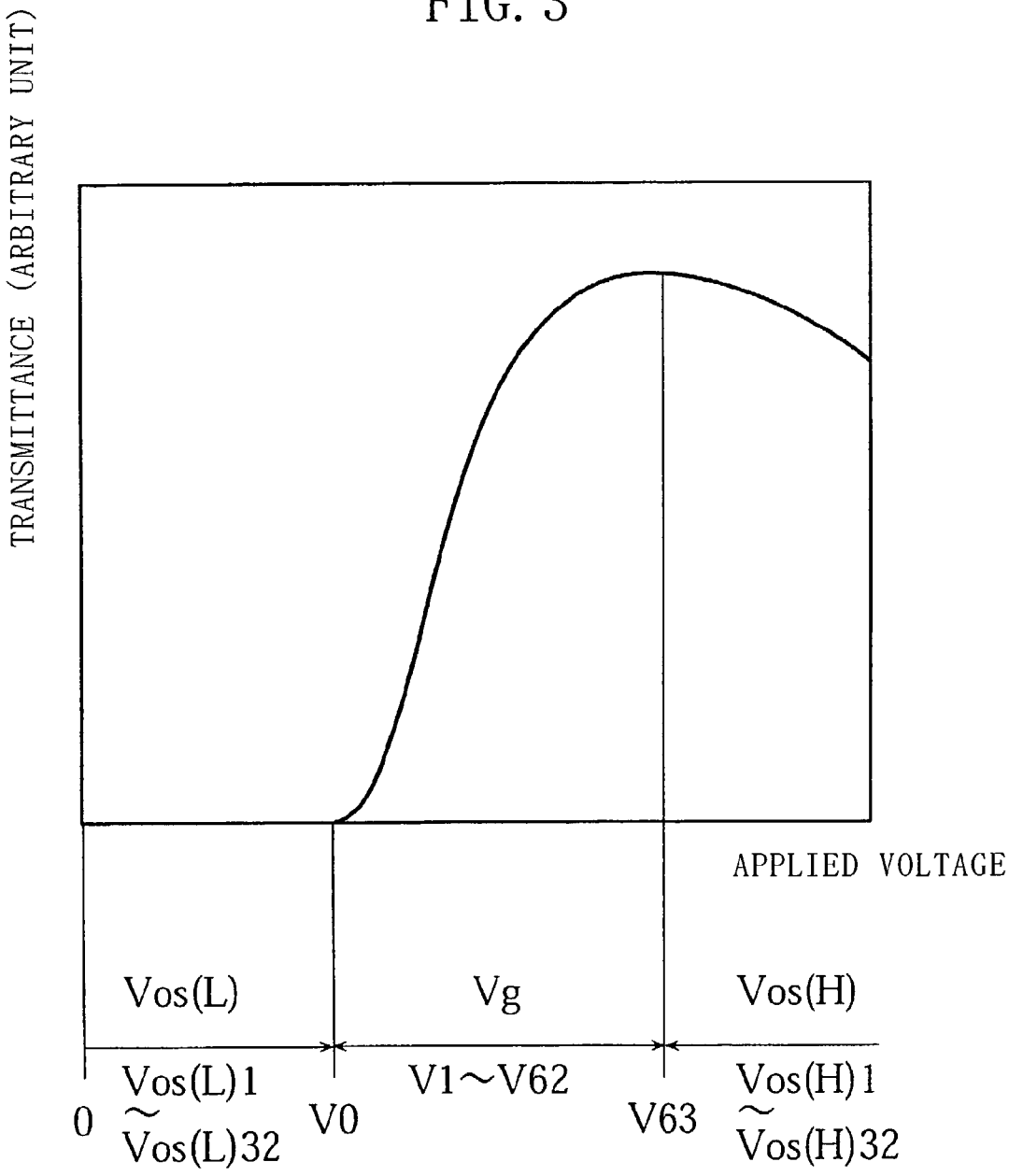
FIG. 3 is a schematic diagram illustrating the relationship of a V-T curve of a liquid crystal panel provided in a liquid crystal display device of one embodiment of the present invention with respect to overshoot driving voltages Vos and gray level voltages Vg.

Next, how to set the overshoot driving voltages Vos and the gray level voltages Vg will be described in detail with reference to FIG. 3. FIG. 3 illustrates the relationship of a V-T curve with respect to the overshoot driving voltages Vos and the gray level voltages Vg. In the case of the NB mode, the gray level voltages Vg (V0 (black) to V63) are set in a range from a voltage that is equal to or greater than the voltage at which the transmittance takes the lowest value to a voltage that is less than or equal to the voltage at which the transmittance takes the highest value. The low-voltage side overshoot driving voltages Vos(L) (e.g., 32 levels from Vos(L)1 to Vos(L)32) are set in a range from a voltage that is equal to or greater than 0 V to a voltage that is less than V0 (the lowest value of the gray level voltage Vg). The high-voltage side overshoot driving voltages Vos(H) (e.g., 32 levels from Vos(H)1 to Vos(H)32) are set in a range from a voltage that is greater than V63 (the highest value of the gray level voltage Vg) to a voltage that does not exceed the withstand voltage value of the driving circuit. Note that the number of levels of the gray level voltage Vg and the number of levels of the overshoot driving voltage Vos may suitably be determined as long as the total number does not exceed the number of bits of the driving circuit. The number of levels of the low-voltage side overshoot driving voltage Vos(L) may be different from the number of levels of the high-voltage side overshoot driving voltage Vos(H).

Voltages to be applied in an overshoot driving operation are predetermined and are associated with different transitions of the input image signal S, and either the gray level voltage Vg or the overshoot driving voltage Vos is used.

For example, in a case where the gray level voltage Vg corresponding to the input image signal S of the current field is higher than the gray level voltage Vg corresponding to the input image signal S of the previous field, one voltage, which is selected from among the gray level voltages Vg and the high-voltage side overshoot driving voltages Vos(H) and is even higher than the gray level voltage Vg corresponding to the input image signal S of the current field, is input to the liquid crystal panel. Each of the voltages used in the overshoot driving operation is predetermined so that a steady transmittance corresponding to the input image signal S of the current field is reached within a predetermined amount of time (e.g., 8 msec) from the application of the voltage of the current field. Alternatively, each of the voltages used in the overshoot driving operation is predetermined so that a visually acceptable transmittance is achieved.

Each of the voltages used in the overshoot driving operation is associated with one combination of the input image signal S (e.g., one of 64 levels) of the previous field and the input image signal S (e.g., one of 64 levels) of the current field (note that it is not necessary to provide an overshoot driving voltage for any combination that does not involve a gray level transition). Depending on the response speed of the liquid crystal panel, there may be gray level combinations that do not require overshoot driving. Moreover, the number of levels of the overshoot driving voltage Vos may suitably be changed.

Circuit #1 for Performing Overshoot Driving Operation

Figure 4A:
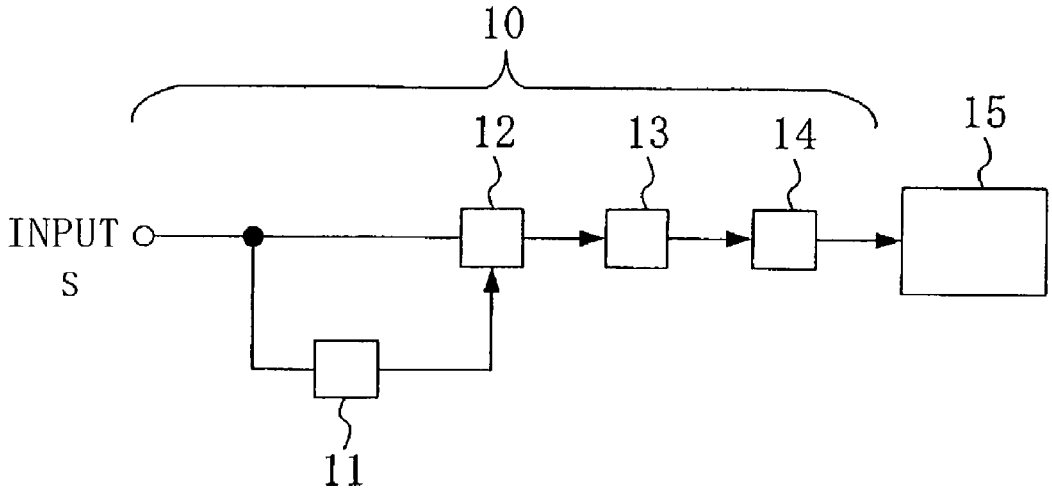
FIG. 4A is a schematic diagram illustrating a configuration of a driving circuit 10 provided in a liquid crystal display device of one embodiment of the present invention.

A configuration of a driving circuit 10 in a liquid crystal display device of one embodiment of the present invention will be described with reference to FIG. 4A.

The driving circuit 10 receives the input image signal S from outside, and supplies a driving voltage to a liquid crystal panel 15 according to the received input image signal S. The driving circuit 10 includes an image memory circuit 11, a combination detection circuit 12, an overshoot voltage detection circuit 13, and a polarity inversion circuit 14.

The image memory circuit 11 stores at least one field of image of the input image signal S. Of course, in a case where one frame is not divided into a plurality of fields, the image memory circuit 11 stores at least one frame of image. The combination detection circuit 12 compares the input image signal S of the current field with the input image signal S of the previous field stored in the image memory circuit 11 so as to output a signal indicating the combination to the overshoot voltage detection circuit 13. The overshoot voltage detection circuit 13 detects a driving voltage corresponding to the combination detected by the combination detection circuit 12 from among the gray level voltages Vg and the overshoot driving voltages Vos. The polarity inversion circuit 14 converts the driving voltage detected by the overshoot voltage detection circuit 13 to an alternating current signal and supplies it to the liquid crystal panel (display section) 15.

The input/output signal for each circuit will be described for a case where the voltage used in a falling overshoot driving operation is predetermined to be a gray level voltage Vg that is lower than that corresponding to the input image signal S.

First, the image memory circuit 11 stores the input image signal S of the previous field, i.e., the field immediately before the current field.

Then, the combination detection circuit 12 detects the combination of the current input image signal S and the input image signal S of the previous field stored in the image memory circuit 11 for each picture element. For example, the combination detection circuit 12 detects a combination (S20, S40) of an input image signal S20 of the previous field and an input image signal S40 of the current field for one picture element.

The overshoot voltage detection circuit 13 detects a gray level voltage V60 (corresponding to an input image signal S60), which is associated with the combination (S20, S40) detected by the combination detection circuit 12, and supplies the gray level voltage V60 as the driving voltage to the polarity inversion circuit 14. This operation is equivalent to the conversion of the input image signal of the current field from S40 to S60. The process of detecting the gray level voltage V60 as an overshoot voltage that is associated with the combination (S20, S40) detected by the combination detection circuit 12 may be performed by using a lookup table method or by performing a predetermined calculation, for example.

Finally, the polarity inversion circuit 14 converts the gray level voltage V60 to an alternating current signal and supplies it to the liquid crystal panel 15.

An overshoot driving operation to be performed by the liquid crystal display device of one embodiment of the present invention using the overshoot driving voltages Vos will now be described.

For example, the overshoot voltage detection circuit 13 is capable of detecting a predetermined driving voltage for overshoot driving that corresponds to the 64-level (6-bit) input image signal S from among the 7-bit collection of voltages (64 gray level voltages Vg (V0 to V63) and 64 overshoot driving voltages Vos (high-voltage side: Vos(H)1 to Vos(H)32, low-voltage side: Vos(L)1 to Vos(L)32)).

Specifically, it is assumed that the current input image signal S40 transitions to S63 at the rise of the next field, for example. The input image signal S40 is stored in the image memory circuit 11. The combination detection circuit 12 detects a combination (S40, S63). Then, the overshoot voltage detection circuit 13 detects an overshoot driving voltage Vos(H)20, which is predetermined so that a steady transmittance corresponding to the input image signal S63 is reached within one field, for example, and supplies it as the driving voltage to the polarity inversion circuit 14. The voltage Vos(H)20 is converted to an alternating current signal by the polarity inversion circuit 14, and is then supplied to the liquid crystal panel.

This operation is equivalent to the conversion by the overshoot voltage detection circuit 13 from a 6-bit digital input image signal S to a 7-bit digital input image signal S including overshoot driving voltages Vos (64 levels).

Note that the driving voltage is not overshot when there is no transition in the input image signal S. For example, when the combination detection circuit 12 detects a combination (S40, S40), the overshoot voltage detection circuit 13 outputs a gray level voltage V40 corresponding to S40 to the polarity inversion circuit 14 as the driving voltage.

The field in which the overshoot driving operation is performed is not limited to the first field after the transition of the input image signal S. The overshoot driving operation may be performed not only in the first field, but also in the next field or the field after the next. Such a driving operation can be performed by a suitable combination of circuits. Note that in a case where the device is driven while each frame is divided into a plurality of fields, it is preferred to perform the overshoot driving operation in the first field or in all fields. Moreover, in a case where the overshoot driving operation is performed in more than one field in each frame, the overshoot amount (i.e., the amount of shift from the predetermined gray level voltage Vg) may vary from one field to another. For example, the overshoot driving operation may be performed in the second field with a smaller overshoot amount than that used in the first field.

Circuit #2 for Performing Overshoot Driving Operation

Suitable driving circuits to be combined together for performing the overshoot driving operation not only in the first field, but also in the next field or the field after the next will now be described.

The memory circuit used in the liquid crystal display device of the present invention is any memory circuit capable of storing a signal with which the overshoot voltage can be more appropriately determined. Typically, the transmittance of the liquid crystal panel in the current field coincides with the transmittance that is defined by the input image signal S of the previous field. Therefore, the image memory circuit 11 as described above stores the input image signal S of the previous field.

However, the response time of a liquid crystal panel typically varies significantly depending on the environmental conditions, the driving conditions, etc. For example, under low-temperature environments, the intended transmittance may not be reached even if an overshoot voltage is applied. In such a case, the transmittance of the liquid crystal panel is different from the transmittance that is defined by the input image signal S of the previous field stored in the image memory circuit 11, thereby causing an error in the overshoot voltage to be applied in the next field.

This problem can be addressed by storing a signal that has been processed appropriately in view of the transmittance of the liquid crystal panel in the current field, instead of simply storing the input image signal S of the previous field. For example, it is possible to estimate the transmittance to be reached within the field in response to the applied overshoot voltage, and to store the estimated transmittance as a signal of the previous field. It is of course apparent that such a method is merely an alternative embodiment of the present invention.

Figure 4B:
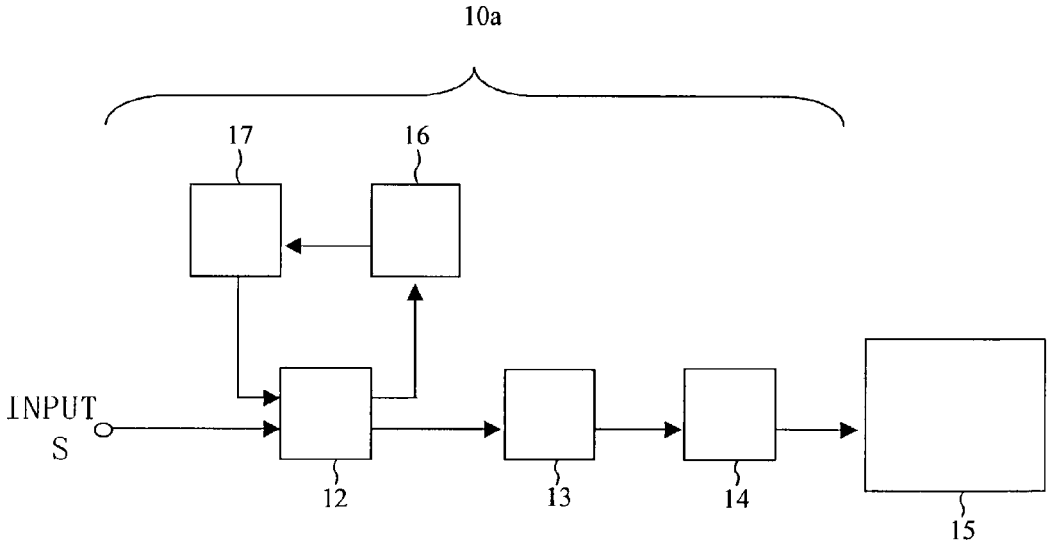
FIG. 4*b* is a schematic diagram illustrating a configuration of a driving circuit 10*a* provided in a liquid crystal display device of one embodiment of the present invention.

A specific example of the suitable combination of circuits will now be described with reference to FIG. 4B. Note that FIG. 4B only shows what is necessary to illustrate the specific example.

A driving circuit 10*a* receives an input image signal from outside, and supplies a driving voltage to the liquid crystal panel 15 according to the received input image signal. The driving circuit 10*a* includes the combination detection circuit 12, the overshoot voltage detection circuit 13, the polarity inversion circuit 14, an estimate value detection circuit 16, and an estimate value memory circuit 17.

The combination detection circuit 12 compares the estimate signal stored in the estimate value memory circuit 17 with the input image signal of the current field, and outputs a signal indicating the combination to the estimate value detection circuit 16 and to the overshoot voltage detection circuit 13. The estimate value detection circuit 16 detects a signal corresponding to the combination detected by the combination detection circuit 12. The estimate value memory circuit 17 stores the signal detected by the estimate value detection circuit 16. The signal to be stored corresponds to at least one field image of the input image signal. In a case where one frame is not divided into a plurality of fields, the estimate value memory circuit 17 stores a signal corresponding to at least one frame of image. On the other hand, the overshoot voltage detection circuit 13 detects a driving voltage corresponding to the combination detected by the combination detection circuit 12 from among the gray level voltages Vg and the overshoot driving voltages Vos. The polarity inversion circuit 14 converts the driving voltage detected by the overshoot voltage detection circuit 13 to an alternating current signal and supplies it to the liquid crystal panel (display section) 15.

The transition of the signal to be detected by the estimate value detection circuit 16 over two fields will be described. For example, it is assumed that the input image signal for one pixel transitions from S0 to S128 and then to S128 over the two fields.

It is assumed that in the first field, the input image signal of the current field is S128, while a signal S0 is stored in the estimate value memory circuit 17 for the same pixel. In such a case, the combination detection circuit 12 detects the combination (S0, S128) of the input image signal S128 of the current field and the signal S0 stored in the estimate value memory circuit 17. The estimate value detection circuit 16 detects a predetermined estimate signal S64 that is associated with the combination (S0, S128) detected by the combination detection circuit 12, and the estimate signal S64 is stored in the estimate value memory circuit 17. On the other hand, the overshoot voltage detection circuit 13 detects a predetermined gray level voltage V160 that is associated with the combination (S0, S128) detected by the combination detection circuit 12, and supplies the gray level voltage V160 as the driving voltage to the polarity inversion circuit 14.

Then, in the second field, the input image signal is S128. The combination detection circuit 12 detects a combination (S64, S128) of the input image signal S128 of the current field and the estimate signal S64 stored in the estimate value memory circuit 17. The estimate value detection circuit 16 detects a predetermined estimate signal S96 that is associated with the combination (S64, S128) detected by the combination detection circuit 12, and the estimate signal S96 is stored in the estimate value memory circuit 17. On the other hand, the overshoot voltage detection circuit 13 detects a predetermined gray level voltage V148 that is associated with the combination (S64, S128) detected by the combination detection circuit 12, and supplies the gray level voltage V148 as the driving voltage to the polarity inversion circuit 14.

It is preferred that the estimate signal detected by the estimate value detection circuit 16 corresponds to a transmittance that is to be reached one field after, i.e., when the gray level voltage detected by the overshoot voltage detection circuit 13 is applied. In other words, it is preferred that an estimate signal in the previous vertical period corresponds to the transmittance of the liquid crystal panel in the current vertical period.

As described above, with the driving circuit 10*a* including the estimate value detection circuit 16 and the estimate value memory circuit 17, the gray level voltage transitions from V0 to V160 and then to V148 when the input image signal for one pixel transitions from S0 to S128 and then to S128.

Thus, it is possible to perform an overshoot driving operation over successive fields. Performing an overshoot driving operation over successive fields is effective in a case where the response speed is low, and thus the target transmittance cannot be reached within one field even if an overshoot voltage is applied.

Change in Transmittance with Overshoot Driving

The response characteristic of a liquid crystal display device of one embodiment of the present invention when an overshoot driving operation is performed will now be described with reference to FIG. 1.

FIG. 1 illustrates a V-T curve of a liquid crystal display device of the present embodiment (a liquid crystal panel whose retardation at an applied voltage of 5.7 V is 300 nm) and that of a liquid crystal display device of a comparative example (a liquid crystal panel whose retardation at an applied voltage of 5.7 V is 220 nm). In the V-T curve of the liquid crystal panel of the present embodiment, the transmittance has an extreme value between the highest gray level voltage and the maximum voltage that can be applied across the liquid crystal panel. In contrast, there is no extreme value in the V-T curve of the liquid crystal panel of the comparative example. The liquid crystal layers of these two liquid crystal panels are made of different liquid crystal materials that have the same dielectric anisotropy ($\Delta\in$) and the same viscosity with different refractive indices.

As the applied voltage is gradually increased from zero, the transmittance of the liquid crystal panel whose retardation at an applied voltage of 5.7 V is 300 nm exhibits a local maximum value at around a point where the voltage exceeds 5 V, and then starts decreasing. Note that while FIG. 1 illustrates a case where the retardation at an applied voltage of 5.7 V is 300 nm, the transmittance exhibits an extreme value at a voltage less than or equal to 7 V even in a case where the retardation at an applied voltage of 5.7 V is 280 nm. Moreover, also with a liquid crystal panel whose retardation at an applied voltage of 5.7 V is 260 nm, an extreme value of transmittance is exhibited at a voltage of about 6 V. Thus, a liquid crystal panel whose maximum retardation is 280 nm or more, or a liquid crystal panel whose retardation takes a value of 260 nm or more between the highest gray level voltage and the maximum voltage that can be applied across the liquid crystal panel, exhibits a local maximum value in the V-T curve.

On the other hand, the transmittance of the liquid crystal panel whose retardation at an applied voltage of 5.7 V is 220 nm increases as the applied voltage is gradually increased from zero, and does not exhibit a local maximum value even if the applied voltage is increased to the maximum voltage that can be applied across the panel (typically, the highest voltage among the high-voltage side overshoot driving voltages (OS), e.g., 7 V).

Figure 5A:
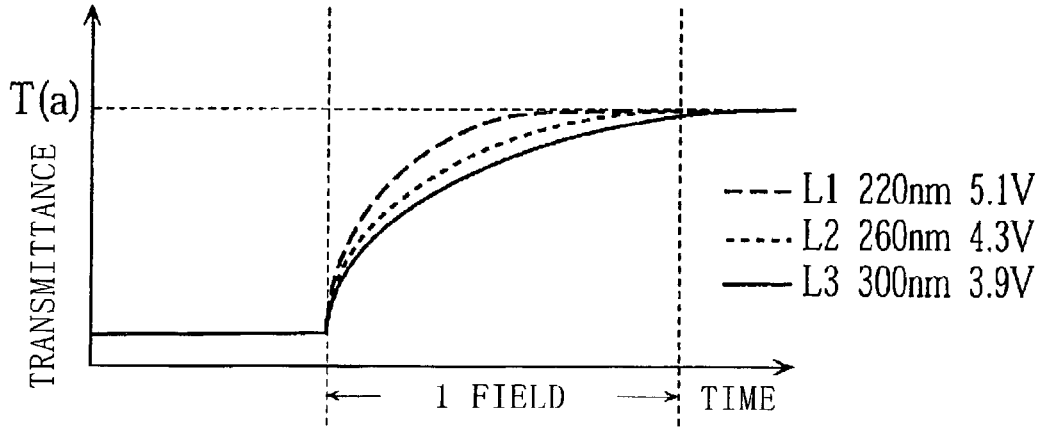
FIG. 5A is a graph schematically illustrating a change over time of the transmittance for liquid crystal display devices of one embodiment of the present invention.
Figure 5B:
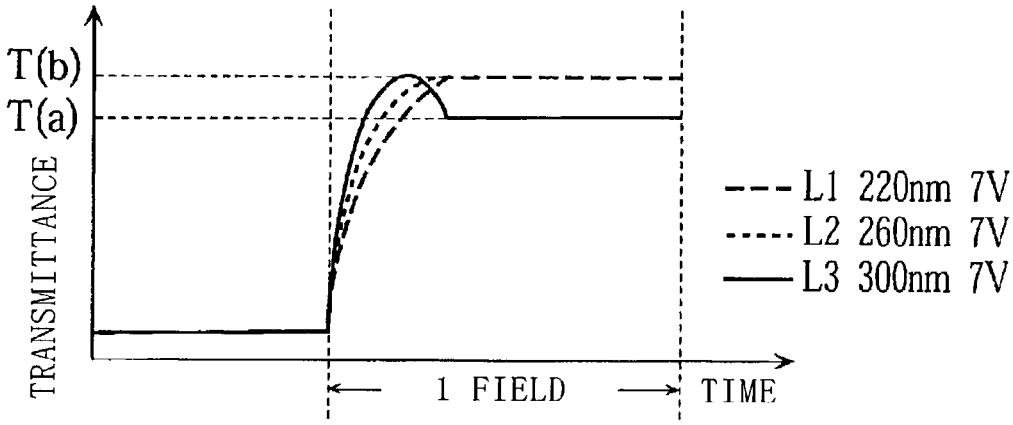
FIG. 5B is a graph schematically illustrating a change over time of the transmittance for liquid crystal display devices of one embodiment of the present invention.
Figure 5C:
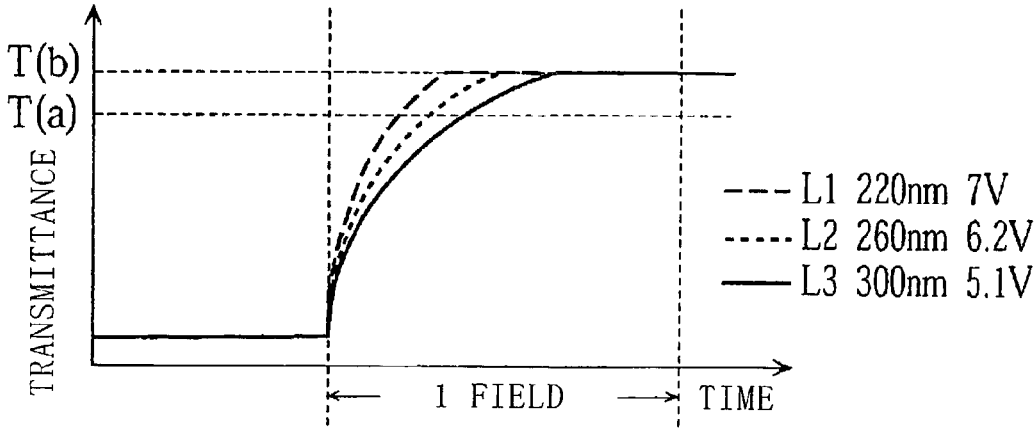
FIG. 5C is a graph schematically illustrating a change over time of the transmittance for liquid crystal display devices of one embodiment of the present invention.

FIG. 5A to FIG. 5C are graphs each schematically illustrating a change over time of the transmittance for liquid crystal display devices of the present embodiment. In the figures, the time interval delimited by broken lines corresponds to one field, and the figures each illustrate a transition from the first field of a black display (the lowest gray level: S0) to the second field of a white display (the highest gray level: S63).

In FIG. 5A, curves L1, L2 and L3 are for liquid crystal panels whose retardations at an applied voltage of 5.7 V are 220 nm, 260 nm and 300 nm, respectively. These retardations are realized by using liquid crystal layers that have substantially the same $\Delta\in$ value and substantially the same cell gap with different $\Delta n$ values, for example. In the illustrated example, the highest gray level voltage is applied across the liquid crystal panels in the second field. The highest gray level voltages for the liquid crystal panels are respectively set to be voltages at which the liquid crystal panels take about the same steady transmittance T(a). For each liquid crystal panel, the highest gray level voltage is a voltage lower than the voltage at which the liquid crystal panel takes the highest transmittance. Specifically, the highest gray level voltages for the liquid crystal panels whose retardations at an applied voltage of 5.7 V are 220 nm, 260 nm and 300 nm are 5.1 V, 4.3 V and 3.9 V, respectively. Since the rising response time is dependent on the applied voltage, the 220-nm panel has the shortest response time and the 300-nm panel has the longest response time.

On the other hand, in FIG. 5B, curves L1, L2 and L3 are for the liquid crystal panels whose retardations at an applied voltage of 5.7 V are 220 nm, 260 nm and 300 nm, respectively, where the maximum voltage (7 V) that can be applied across the liquid crystal panels is applied in the second field. Since the applied voltage is the same, the panels have the same amount of time before a steady state is reached. However, the transmittance curve varies depending on the retardation. Specifically, the transmittance curve is steeper for the 260-nm panel than for the 220-nm panel. Moreover, the transmittance curve of the 300-nm panel has a local maximum value, and is steepest for the portion of the transmittance curve before reaching the transmittance T(a). Such a variation occurs due to the various retardations of the liquid crystal panels, and because the transmittance takes the highest value at a retardation of 260 nm.

FIG. 5C illustrates time-transmittance curves under application of voltages, in the second field, at which the panels each take the highest transmittance T(b) among various steady transmittances that are reached in response to various voltages from 0 V to 7 V. The voltages applied across the 220-nm panel, 260-nm panel and the 300-nm panel are 7 V, 6.2 V and 5.1 V, respectively. Since the rising response time is dependent on the applied voltage, the shortest response time occurs when 7 V is applied.

It can be seen from the above that the transmittance increases very steeply in the second field, as illustrated in the curve L3 in FIG. 5B, when 7 V is applied across a liquid crystal panel whose retardation at an applied voltage of 5.7 V is 300 nm or more. The present embodiment provides a liquid crystal display device, in which the rising response characteristic is improved and which can suitably be used for displaying a motion picture, by utilizing the steep transmittance change as described above.

Figure 6:
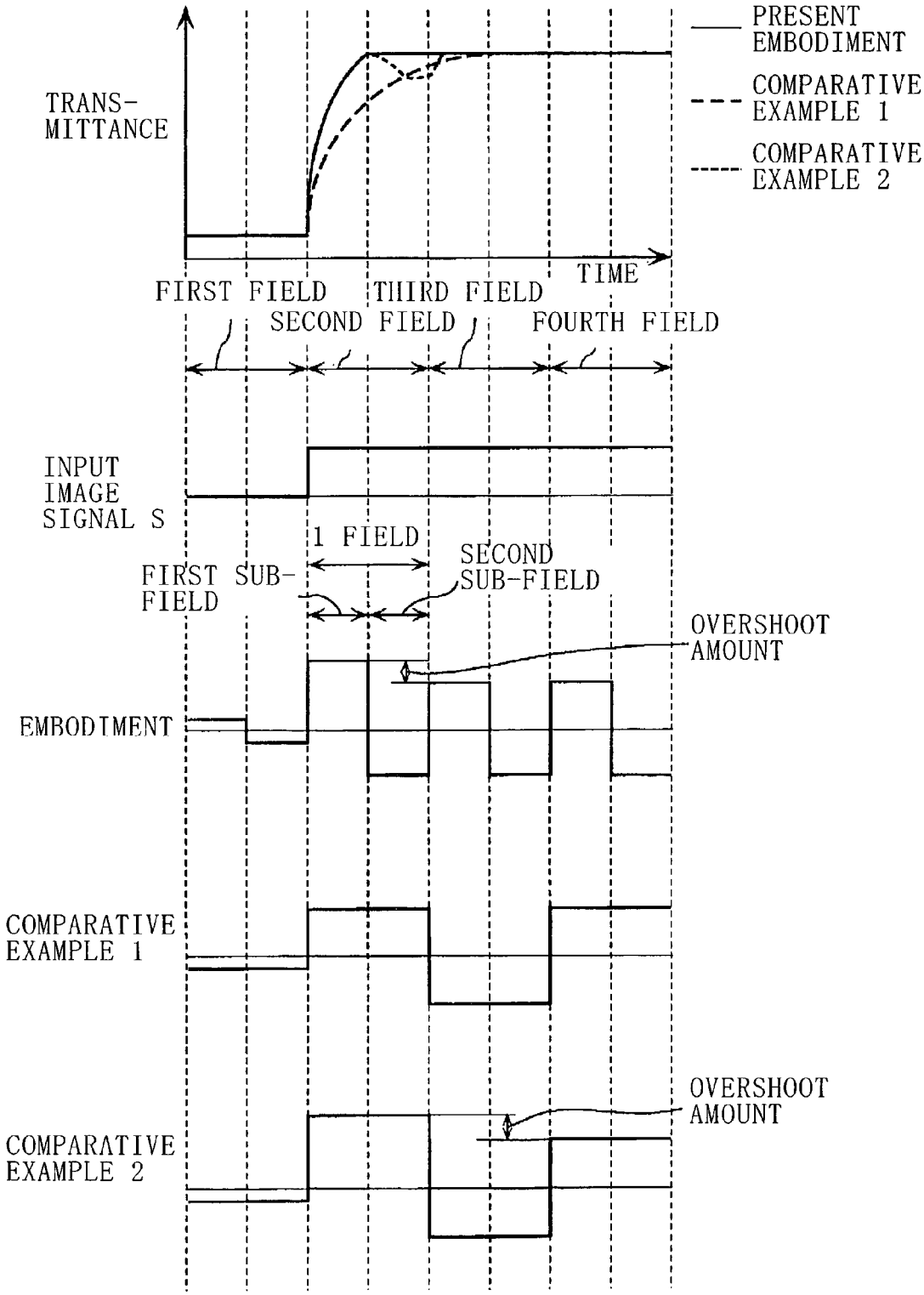
FIG. 6 is a diagram illustrating a response characteristic of a liquid crystal display device of one embodiment of the present invention, showing the input image signal S, the transmittance and the voltage output to the liquid crystal panel together with those of comparative examples.

The present embodiment and comparative examples will be described with reference to FIG. 6. The liquid crystal panel is adjusted so that the retardation takes a value of 300 nm at an applied voltage of 5.7 V, with the highest gray level voltage being 5.1 V. By setting the highest gray level voltage to be 5.1 V, it is possible to use the highest transmittance T(b) for display, since the liquid crystal panel of the present embodiment exhibits a local maximum value in the V-T curve at an applied voltage of 5.1 V. Assume a case where the video signal transitions as follows: black (S0) in the first field, white (S63, which corresponds to the steady transmittance reached in response to an applied voltage of 5.1 V) in the second field, white (S63) in the third field, and white (S63) in the fourth field. Note that each field of video signal is divided into two sub-fields. The gray level voltage is V0 in the first sub-field and the second sub-field of the first field, Vos(H)32 (corresponding to 7 V) in the first sub-field of the second field, and V63 (5.1 V) in the second sub-field of the second field and in each sub-field of the third and fourth fields. The time-transmittance curve is as illustrated in FIG. 6. With the same input image signal (S) being used for the present embodiment and the comparative examples, such a transmittance change of the present embodiment is realized by refreshing each pixel at a rate twice as high as that for the comparative examples. Specifically, each field of image signal is divided into two sub-fields, and an overshoot driving voltage V (7 V) is applied in the first sub-field while applying a voltage V (5.1 V) that corresponds to the predetermined gray level voltage Vg in the second sub-field. In other words, the frequency with which a driving voltage is supplied to the liquid crystal panel is doubled, with an overshoot driving operation being performed in the first sub-field. Thus, the steep transmittance change is realized. In this way, it is possible to prevent the transmittance from decreasing after the transmittance once increases to be the predetermined transmittance or more, as illustrated in the curve L3 in FIG. 5B.

Next, Comparative Example 1 will be described. The settings (the retardation, the gray level voltage) of the panel are the same as those of the present embodiment, and the input image signal S transitions as described above. The gray level voltage is V0 in the first field, and V63 (5.1 V) in the second to fourth fields. The time-transmittance curve is as illustrated in FIG. 6.

Comparative Example 2 is similar to Comparative Example 1 except that 7 V is applied in the second field. It is not preferred because there is a drop in the transmittance in the latter half of the second field, as illustrated in FIG. 6.

Furthermore, the liquid crystal panel of the present embodiment is compared with a liquid crystal panel whose retardation value at an applied voltage of 5.7 V is 220 nm. When the voltage (7 V) at which the transmittance takes the maximum value is set to be the highest gray level voltage (V63), a voltage higher than the highest gray level voltage (7 V) cannot be applied across the panel, whereby it is not possible to reduce the response time.

The liquid crystal panel of the present embodiment is compared with a liquid crystal panel whose retardation value at an applied voltage of 5.7 V is 260 nm. The voltage (6.2 V) at which the transmittance takes the maximum value is set to be the highest gray level voltage (V63). In such a case, it is possible to perform an overshoot driving operation (by applying 7 V), thereby providing an effect of making the time-transmittance curve steeper. Note however that the effect is more pronounced in a case where the retardation at an applied voltage of 5.7 V is 300 nm, as illustrated in FIG. 5B.

As described above, the use of a liquid crystal panel whose retardation at an applied voltage of 5.7 V is 300 nm or more (a liquid crystal panel whose maximum retardation is 280 nm or more, or a liquid crystal panel whose retardation takes a value of 260 nm or more in response to an applied voltage between the highest gray level voltage and the maximum voltage that can be applied across the liquid crystal panel) provides an advantage that the highest transmittance of the liquid crystal panel can be used for display. In other words, with a liquid crystal display device that exhibits a local maximum value in the V-T curve, it is possible to obtain an advantage that the response characteristic can be improved without sacrificing the transmittance, by setting the voltage at which the transmittance takes a local maximum value (which is also the maximum value) to be the highest gray level voltage, and by performing an overshoot driving operation using overshoot driving voltages.

As described above, the present embodiment provides a liquid crystal display device in which the rising response characteristic is improved and which can suitably be used for displaying a motion picture. With a liquid crystal panel having a liquid crystal layer whose response speed is relatively high so that a steady transmittance corresponding to the applied voltage can be reached within one field without performing an overshoot driving operation, the present embodiment can further improve the response characteristic, thereby increasing the amount of time for which the liquid crystal panel retains a predetermined display state (i.e., the time integration value of the transmittance). Thus, it is possible to improve not only the response characteristic but also the display quality (the brightness, the contrast ratio, etc.).

Thus, according to the present invention, it is possible to obtain a liquid crystal display device having a high response speed that is suitable for displaying a motion picture.

Display Modes

The present invention can be used with various types of liquid crystal display devices. Although a vertical-alignment-type NB-mode liquid crystal display device has been described in the embodiment above, the present invention can also be used with a horizontal-alignment-type NB-mode liquid crystal display device. Moreover, the present invention can also be used with a horizontal-alignment-type or vertical-alignment-type NW-mode liquid crystal display device.

Note however that the response characteristic of a liquid crystal panel is dependent on the response speed of the liquid crystal layer (the liquid crystal material, the mode of orientation, etc.). Thus, it is possible to obtain a liquid crystal display device that is faster and that has better motion picture display characteristics by using a liquid crystal layer having a high response speed.

Display Mode: NW Mode

Figure 7:
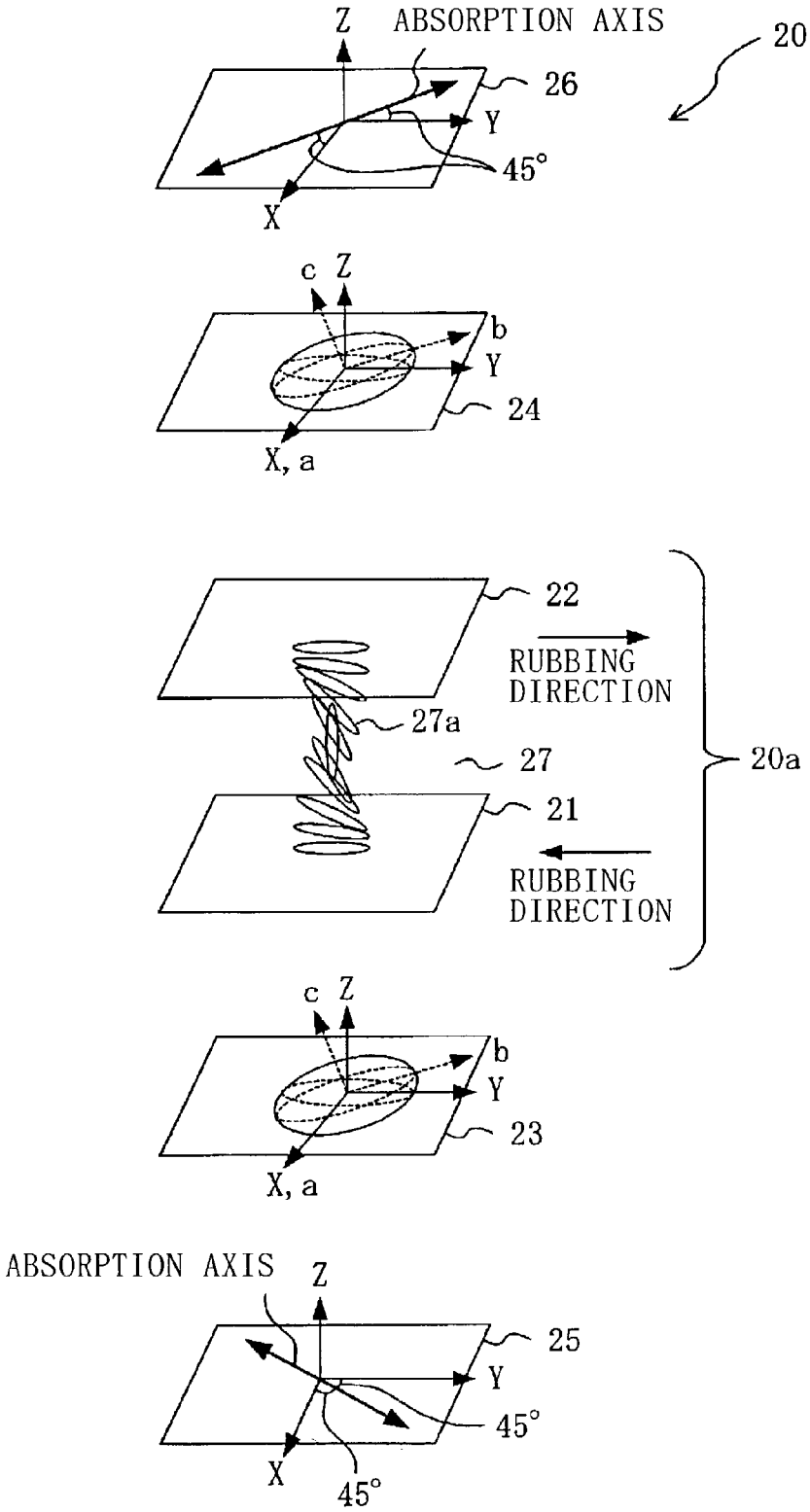
FIG. 7 is a diagram schematically illustrating an NW-mode transmission-type liquid crystal panel using a horizontal-alignment-type liquid crystal layer, which is provided in a liquid crystal display device of one embodiment of the present invention.

FIG. 7 schematically illustrates a transmission-type liquid crystal panel 20 of an ECB (electrically controlled birefringence) mode using a horizontal-alignment-type (homogeneous-alignment-type) liquid crystal layer, which is known to be an NW mode having a high response speed.

The liquid crystal panel 20 includes a liquid crystal cell 20*a*, a pair of polarizers 25 and 26 interposing the liquid crystal cell 20*a* therebetween, and a pair of phase difference compensators 23 and 24 provided between the liquid crystal cell 20*a* and the polarizers 25 and 26, respectively.

The liquid crystal cell 20*a* includes a liquid crystal layer 27 provided between a pair of substrates 21 and 22. The substrates 21 and 22 each include a transparent substrate (e.g., a glass substrate), a transparent electrode (not shown) provided on one side of the transparent substrate that is closer to the liquid crystal layer 27 for applying a voltage across the liquid crystal layer 27, and an alignment film (not shown) for defining the orientation direction of liquid crystal molecules 27*a* of the liquid crystal layer 27. Of course, a color filter layer (not shown), etc., are further provided as necessary. The transparent electrodes are made of ITO (indium tin oxide), for example.

The liquid crystal layer 27 is a horizontal-alignment-type liquid crystal layer, and the liquid crystal molecules 27*a* in the liquid crystal layer 27 are substantially parallel (though slightly shifted from being parallel by the pretilt angle) to the surface plane of the liquid crystal layer 27 (parallel to the substrate surface) and are also substantially parallel (no influence from the pretilt angle) to one another in the absence of an applied voltage. The refractive index ellipsoid of the liquid crystal molecules in the liquid crystal layer 27 (referred to as "anchoring layer") that are anchored by an alignment film (not shown) is slightly inclined clockwise by the pretilt angle about the X axis in the XYZ coordinate system, in which the surface plane of the liquid crystal layer 27 (i.e., the display plane) is an X-Y plane.

A horizontal-alignment-type liquid crystal layer is obtained by rubbing the alignment films, which are provided on the opposite sides of the liquid crystal layer 27, in antiparallel directions, respectively (see rubbing direction arrows in FIG. 7). Note that if the alignment films, which are provided on the opposite sides of the liquid crystal layer, are rubbed in parallel, a liquid crystal molecule on one alignment film and a liquid crystal molecule on the other alignment film form an angle that is twice as large as the pretilt angle, whereby the liquid crystal molecules 27*a* are no longer parallel to one another.

The pair of polarizers (e.g., polarizing plates or polarizing films) 25 and 26 are arranged so that the absorption axes (arrows in FIG. 7) are perpendicular to each other and are at an angle of 45° with the rubbing direction (the orientation direction of the liquid crystal molecules in the surface plane).

As illustrated in FIG. 7, the refractive index ellipsoid (having principal axes a, b and c) of each of the phase difference compensators (e.g., phase plates or phase films) 23 and 24 is slightly rotated about the axis a that is parallel to the X axis in the XYZ coordinate system, in which the surface plane of the liquid crystal layer 27 (i.e., the display plane) is an X-Y plane. In the illustrated example, the Y axis is set to be parallel (or antiparallel) to the rubbing direction, and the b axis of the refractive index ellipsoid is inclined from the Y axis. Thus, the long axis (b axis) of the refractive index ellipsoid is inclined counterclockwise about the X axis in the Y-Z plane. The phase difference compensators 23 and 24 arranged as described above are referred to as "inclined phase difference compensators".

The phase difference compensators 23 and 24 have a function of compensating for the retardation of the anchoring layer of the liquid crystal layer 27. Even if a voltage of 7 V, for example, is applied across the liquid crystal layer 27, the liquid crystal molecules that are anchored by an alignment film (not shown) retain their orientation parallel to the surface plane of the liquid crystal layer 27. Therefore, the retardation of the liquid crystal layer 27 does not reach zero. The retardation is compensated for (canceled) by the phase difference compensators 23 and 24.

Assume a typical case where the principal refractive indices na, nb and nc in the respective principal axis directions are in the relationship of na=nb>nc. Wherein, na may not be equal to nb when the relationships of na>nc and nb>nc are satisfied.

Figure 8:
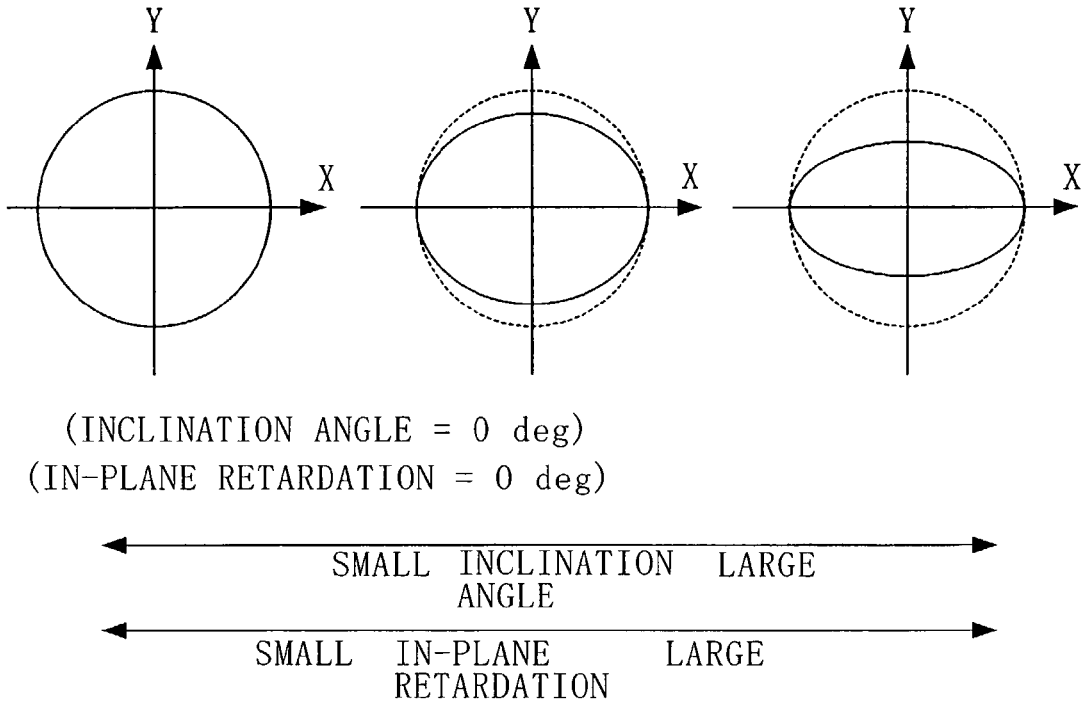
FIG. 8 is a diagram illustrating a function of a phase difference compensator used in one embodiment of the present invention.

As schematically illustrated in FIG. 8, if the inclination angle of the refractive index ellipsoid of the phase difference compensators 23 and 24 (i.e., the angle between the b axis and the Y axis) is 0°, the front retardation (the retardation for light that is incident from the direction normal to the display plane (which is parallel to the Z axis in the figure)) of the phase difference compensators 23 and 24 is zero. However, as the inclination angle increases, the retardation occurs and increases. This can be understood from FIG. 8, which shows that as viewed from the direction normal to the display plane, the refractive index ellipsoid whose inclination angle is 0° appears to be a complete circle, while the refractive index ellipsoid appears more elliptical as the inclination angle increases.

By arranging the phase difference compensators 23 and 24 having an inclined refractive index ellipsoid as described above so that the inclination direction (the direction of the b axis) and the rubbing direction are parallel or antiparallel to each other, it is possible to cancel the retardation of the anchoring layer with the front retardation of the phase difference compensators 23 and 24. Thus, with the example described above, the retardation of the liquid crystal layer 27 at an applied voltage of 7 V can be canceled (i.e., the retardation of the liquid crystal panel 20 at an applied voltage of 7 V can be brought to zero) so as to realize a transmittance of 0%, i.e., a black display.

Figure 9:
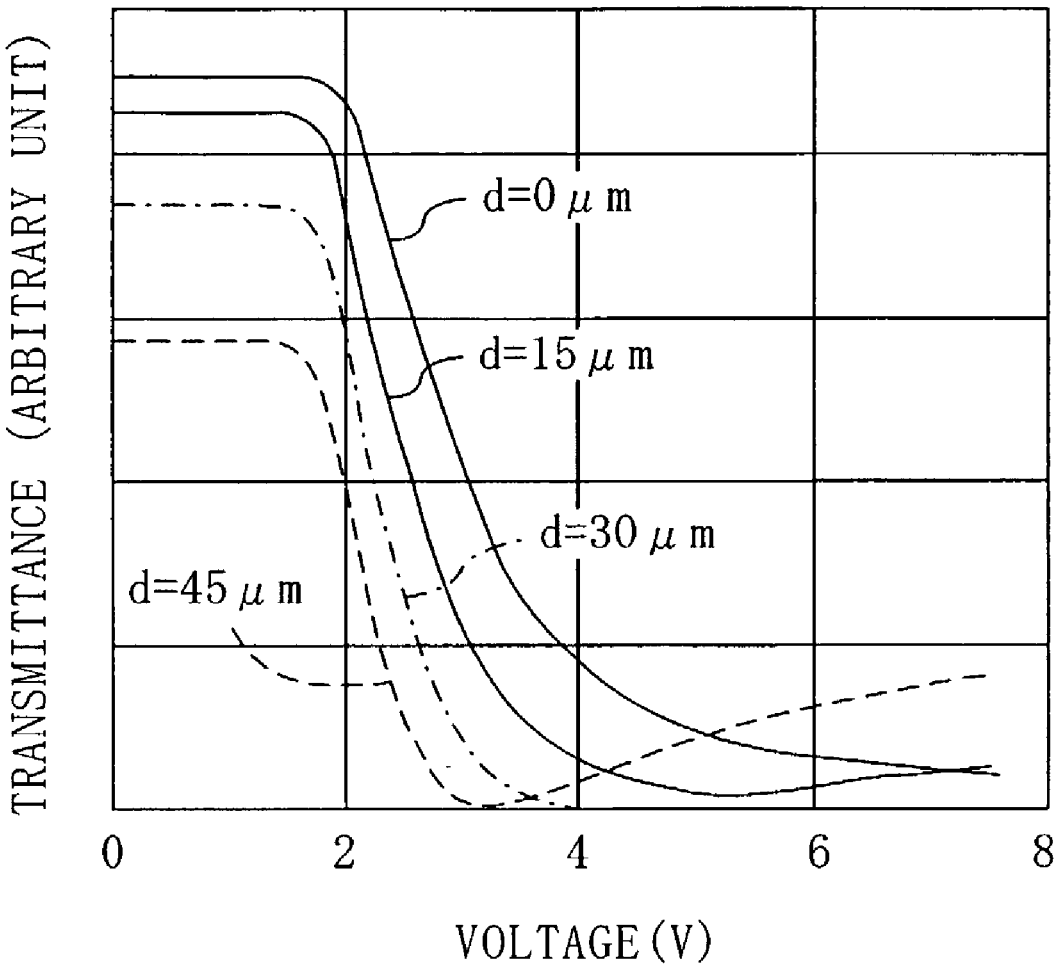
FIG. 9 is a graph illustrating the influence of the thickness of a phase difference compensator on the V-T curve of a liquid crystal panel.

The front retardation of the phase difference compensators 23 and 24 can be adjusted by changing the principal refractive indices, the inclination angle and the thickness of the refractive index ellipsoid thereof The amount of retardation of the liquid crystal cell 20*a* to be canceled can be changed by changing the front retardation of the phase difference compensators 23 and 24. Therefore, the range of the gray level voltages Vg can be adjusted to any range by canceling not only the retardation of the anchoring layer of the liquid crystal layer 27 but also the retardation of the liquid crystal layer 27 under application of a certain voltage. For example, FIG. 9 illustrates V-T curves of the liquid crystal panel 20 for various thicknesses d of the phase difference compensators 23 and 24 (thickness in the direction normal to the display plane) with the principal refractive indices and the inclination angle of the refractive index ellipsoid being fixed. Note that the transmittance is measured in the direction normal to the display plane. Thus, it can be seen that the V-T curve can be controlled by controlling the optical characteristics of the phase difference compensators 23 and 24. Of course, it is apparent from the above description that similar effects can be obtained alternatively by controlling the inclination angle or the principal refractive indices of the refractive index ellipsoid.

The response time of the liquid crystal panel 20 (with a conventional driving method that does not use overshoot driving) is about one half of the typical response time (30 ms) of a conventional TN-mode liquid crystal panel. A possible interpretation is that the short response time is due to the simplicity of the orientation because a homogeneous-alignment-type liquid crystal layer does not have a twisted orientation, whereas a liquid crystal layer of a TN-mode liquid crystal panel has a twisted orientation.

Furthermore, an optical element that diffuses, in the upward/downward direction with respect to the line of sight of the viewer, the transmitted light (display light) in, or approximately in, the direction normal to the display plane, i.e., an optical element having a lens effect in the linear direction (e.g., a BEF film manufactured by Sumitomo 3M Ltd.), may be provided on the display surface of the liquid crystal panel 20. In this way, it is possible to obtain the liquid crystal panel 20 having a very wide viewing angle and thus a substantially constant display quality as viewed from any angle.

Display Mode: NB Mode

Figure 10:
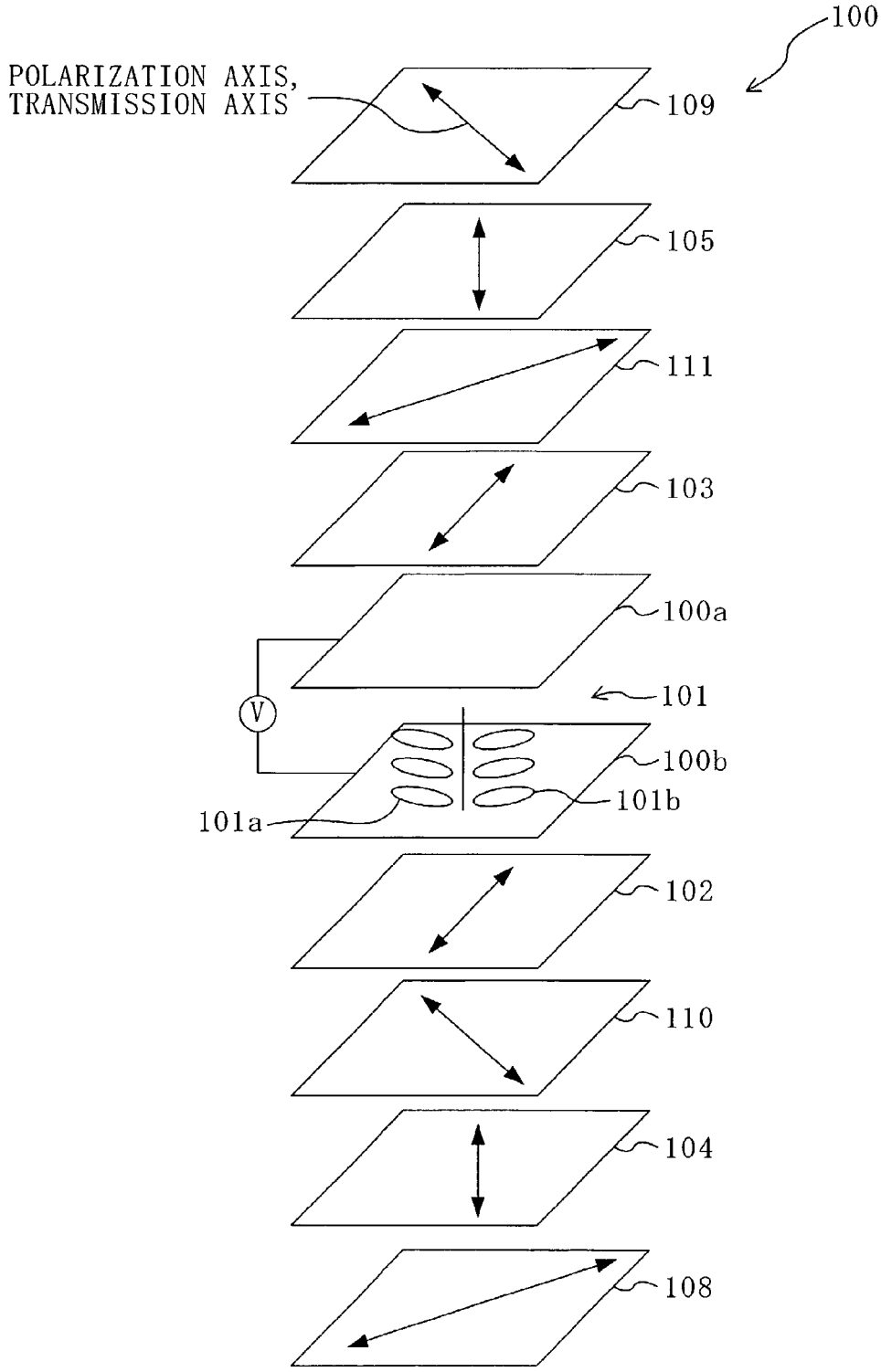
FIG. 10 is a diagram schematically illustrating an NB-mode transmission-type liquid crystal panel using a divided-orientation-type liquid crystal layer, which is provided in a liquid crystal display device of one embodiment of the present invention.

FIG. 10 schematically illustrates a liquid crystal panel 100 of an ECB (electrically controlled birefringence) mode using a horizontal-alignment-type (homogeneous-alignment-type) liquid crystal layer, which is known to be an NB mode having a high response speed and desirable viewing angle characteristics.

The liquid crystal panel 100 includes a liquid crystal layer 101, a pair of electrodes 100*a* and 100*b* for applying a voltage across the liquid crystal layer 101, a pair of phase plates (which may of course be phase difference compensation films alternatively) 102 and 103 provided on the opposite sides of the liquid crystal layer 101, phase plates 104 and 110 provided on the outer side of the phase plate 102, phase plates 105 and 111 provided on the outer side of the phase plate 103, and a pair of polarizing plates 108 and 109 interposing these elements therebetween and being arranged in a crossed-Nicols state. Note that the phase plates 104, 105, 110 and 111 may be omitted, or may be either a single plate or a combination of a plurality of plates.

An arrow shown in each phase plate in FIG. 10 is an axis along which the refractive index ellipsoid of the phase plate (each phase plate has a positive uniaxial characteristic) has the maximum refractive index (i.e., the slow axis). An arrow in each of the polarizing plates 108 and 109 is the polarization axis of the polarizing plate (polarization axis=transmission axis, polarization axis⊥absorption axis).

FIG. 10 illustrates the orientation of liquid crystal molecules (ellipses in FIG. 10) in one display picture element region of the liquid crystal layer 101 in the absence of an applied voltage. The liquid crystal material is a nematic liquid crystal material having a positive dielectric anisotropy. The liquid crystal molecules are oriented substantially parallel to the surface of a pair of substrates (not shown) in the absence of an applied voltage. An electric field substantially perpendicular to the substrate surface is produced in the liquid crystal layer 101 by applying a voltage between the electrodes 100*a* and 100*b*, which are formed on one side of the substrates that is closer to the liquid crystal layer 101 so as to interpose the liquid crystal layer 101 therebetween. The liquid crystal layer 101 includes a first domain 101*a* and a second domain 101*b* in each picture element region with different orientations, as illustrated in FIG. 10. In the example illustrated in FIG. 10, the director of the liquid crystal molecules in the first domain 101*a* and that in the second domain 101*b* are oriented in azimuth angle directions that are different from each other by 180°.

The orientation of the liquid crystal molecules is controlled so that when a voltage is applied between the electrodes 100*a* and 100*b*, the liquid crystal molecules in the first domain 101*a* rise clockwise while the liquid crystal molecules in the second domain 101*b* rise counterclockwise, i.e., so that the liquid crystal molecules in the first and second domains 101*a* and 101*b* rise in the opposite directions. Such an orientation of the directors of liquid crystal molecules can be realized by a known alignment controlling technique using alignment films. Alternatively, a plurality of first domains and a plurality of second domains in which the directors are oriented at 180° with respect to each other may be provided in each display picture element region. In this way, the display characteristics can be made uniform by an even smaller unit, whereby it is possible to realize even more uniform viewing angle characteristics.

Typically, the phase plates 102 and 103 each have a positive uniaxial refractive index anisotropy, and the slow axis thereof (an arrow in FIG. 10) is arranged perpendicular to the slow axis (not shown) of the liquid crystal layer 101 in the absence of an applied voltage. Therefore, it is possible to suppress the light leakage (degradation in a black display; specifically, a local increase in the transmittance in a black display) occurring due to the refractive index anisotropy of the liquid crystal molecules in the absence of an applied voltage (in a black display).

Typically, the phase plates 104 and 105 each have a positive uniaxial refractive index anisotropy, and the slow axis thereof (an arrow in FIG. 10) is arranged perpendicular to the substrate surface (i.e., perpendicular to the slow axes of the liquid crystal layer 101 and the phase plates 102 and 103), so as to compensate for a change in the transmittance due to a change in the viewing angle. Therefore, it is possible to provide a display with even better viewing angle characteristics by providing the phase plates 104 and 105. Alternatively, the phase plates 104 and 105 may be omitted, or only one of them may be used.

Typically, the phase plates 110 and 111 each have a positive uniaxial refractive index anisotropy, and the slow axis thereof (an arrow in FIG. 10) is arranged perpendicular to the polarization axes of the polarizing plates 108 and 109 (i.e., at an angle of 45° with respect to the slow axes of the liquid crystal layer 101 and the phase plates 102 and 103), so as to adjust the rotation of the polarization axis of elliptically-polarized light. Therefore, it is possible to provide a display with even better viewing angle characteristics by providing the phase plates 110 and 111. Alternatively, the phase plates 110 and 111 may be omitted, or only one of them may be used. The phase plates 102, 103, 104, 105, 110 and 111 do not always need to have a uniaxial refractive index anisotropy, but may alternatively have a positive biaxial refractive index anisotropy.

Embodiment 1

Figure 11:
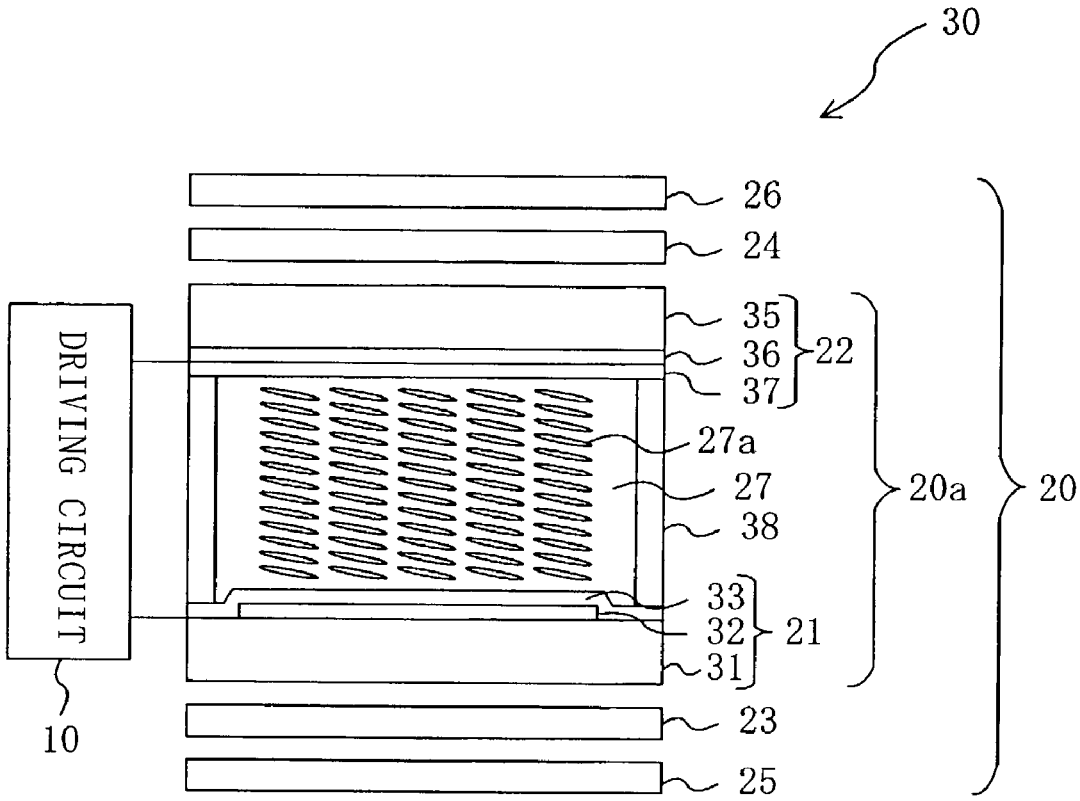
FIG. 11 is a diagram schematically illustrating a liquid crystal display device 30 of Embodiment 1 of the present invention.

FIG. 11 schematically illustrates a cross-sectional view of a liquid crystal display device 30 of Embodiment 1 (in the presence of an applied voltage). The liquid crystal display device 30 of the present embodiment is a NB-mode liquid crystal display device including a vertical-alignment-type liquid crystal layer. The liquid crystal display device 30 includes the driving circuit 10 illustrated in FIG. 4A and the liquid crystal panel 20. The liquid crystal panel 20 of the liquid crystal display device 30 is the same as the liquid crystal panel 20 illustrated in FIG. 7 except that the liquid crystal layer 27 is a vertical-alignment-type liquid crystal layer.

The liquid crystal panel 20 includes a TFT substrate 21 and a color filter substrate (hereinafter referred to as "CF substrate") 22. These substrates can be produced by a known method. The liquid crystal display device 30 of the present invention is not limited to a TFT-type liquid crystal display device. However, it is preferred to use an active-matrix-type liquid crystal display device such as a TFT-type or MIM-type liquid crystal display device in order to realize a high response speed.

The TFT substrate 21 includes a glass substrate 31, a picture element electrode 32 made of ITO and provided on the glass substrate 31, and an alignment film 33 provided on one side of the picture element electrode 32 that is closer to the liquid crystal layer 27. The CF substrate 22 includes a glass substrate 35, a counter electrode (common electrode) 36 made of ITO and provided on the glass substrate 35, and an alignment film 37 provided on one side of the counter electrode 36 that is closer to the liquid crystal layer 27. Note that although not shown, the substrates 21 and 22 include electrode slits or concave/convex portions for regulating the orientation direction of the liquid crystal molecules 27*a*. By providing the electrode slits or the concave/convex portions, the inclination direction of the liquid crystal molecules 27*a* in the presence of an applied voltage can be controlled by the influence of an electric field or the pretilt angle. The orientation of the liquid crystal molecules 27*a* in such a state is schematically illustrated in FIG. 11.

The alignment films 33 and 37 are each a vertical alignment film that by nature aligns the liquid crystal molecules 27*a* vertically, and may be produced by using, for example, polyimide, which is an organic polymer film. The surface of each of the alignment films 33 and 37 is rubbed in one direction. The TFT substrate 21 and the CF substrate 22 are attached to each other so that the rubbing directions are antiparallel to each other, after which a nematic liquid crystal material having a negative dielectric anisotropy $\Delta\in$ is injected into the gap therebetween, thereby obtaining the vertical-alignment-type liquid crystal layer 27. The retardation of the liquid crystal layer 27 alone at an applied voltage of 5 V is set to be 320 nm. The liquid crystal layer 27 is sealed by a sealant 38.

The phase difference compensators 23 and 24 are attached to the outer side of the TFT substrate 21 and the CF substrate 22, respectively, so that the slow axes of the phase difference compensators 23 and 24 are perpendicular to the rubbing directions of the TFT substrate 21 and the CF substrate 22, respectively. The arrangement of the phase difference compensators 23 and 24 and the polarizers 25 and 26 is as described above with reference to FIG. 7.

In the liquid crystal display device 30 of the present embodiment, the transmittance gradually increases as the applied voltage is increased from zero. Thus, the liquid crystal display device 30 is an NB-mode liquid crystal display device.

Next, the operation of the driving circuit 10 as used in the present embodiment will be described in detail.

The input image signals S are 6-bit (64-level) progressive signals with a frequency of 60 Hz/field. The input image signals S are successively stored in the image memory circuit 11. Then, the combination detection circuit 12 detects the combination of the input image signal S of the current field and the input image signal S of the previous field stored in the image memory circuit 11 for each picture element with a frequency of 120 Hz. The detection frequency is 120 Hz in order to perform a double speed refresh operation to be described later. As the frequency of the input image signal S is 60 Hz/field, the input image signal S is converted to a double speed signal with a frequency of 120 Hz at any appropriate point in the driving circuit 10. In the present embodiment, the conversion is done at the combination detection circuit 12.

The overshoot voltage detection circuit 13 for detecting the overshot input image signal S detects a predetermined driving voltage that is associated with the combination detected by the combination detection circuit 12 from among the 7-bit collection of signals (the low-voltage side overshoot driving voltage: 32 levels in the range of 0 V to 2 V, the level voltage: 64 levels in the range of 2.1 V to 5 V, and the high-voltage side overshoot driving voltage: 32 levels in the range of 5.1 V to 7 V). The detected driving voltage (signal) is a 120-Hz signal, and is supplied to the polarity inversion circuit 14. The polarity inversion circuit 14 converts the 120-Hz input image signal S to an 120-Hz alternating current signal, and supplies it to the liquid crystal panel 15. As a result, the display is refreshed at 120 Hz. When the input image signal S transitions from one level to another, a predetermined overshot signal that is associated with the transition of the input image signal S is first input to the liquid crystal panel 20, and then an un-overshot signal is input in the next field.

Furthermore, the operation of the driving circuit 10*a* as used in the present embodiment will be described in detail.

The input image signals S are 6-bit (64-level) progressive signals with a frequency of 60 Hz/field. The combination detection circuit 12 detects a signal (hereinafter referred to as "combination signal") indicating the combination of the input image signal S of the current field and the signal stored in the estimate value memory circuit 17 for each picture element. The detected combination signal is output to the overshoot voltage detection circuit 13 and to the estimate value detection circuit 16.

The overshoot voltage detection circuit 13 detects a predetermined driving voltage that is associated with the combination signal detected by the combination detection circuit 12 from among the 7-bit collection of signals (the low-voltage side overshoot driving voltage: 32 levels in the range of 0 V to 2 V, the level voltage: 64 levels in the range of 2.1 V to 5 V, and the high-voltage side overshoot driving voltage: 32 levels in the range of 5.1 V to 7 V). The detected driving voltage (signal) is a 60-Hz signal, and is supplied to the liquid crystal panel 15 after it is converted to an alternating current signal by the polarity inversion circuit 14.

On the other hand, the estimate value detection circuit 16 detects a predetermined estimate value of transmittance that is associated with the combination signal detected by the combination detection circuit 12. The detected estimate value (signal) is stored in the estimate value memory circuit 17, and then output to the combination detection circuit 12 to be compared with the input image signal of the next field.

Figure 12:
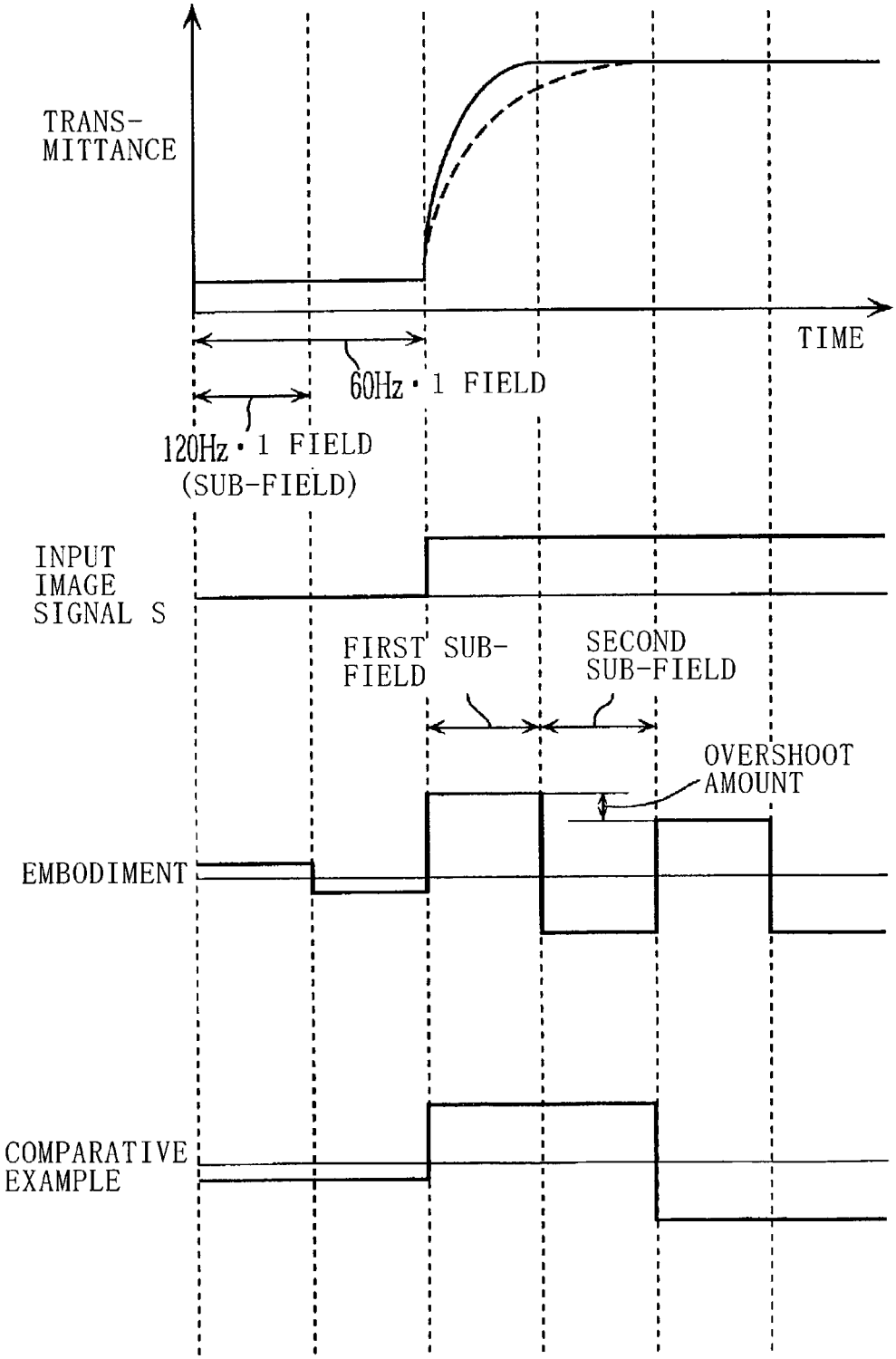
FIG. 12 is a diagram illustrating a response characteristic of the liquid crystal display device 30 of Embodiment 1, showing the input image signal S, the transmittance and the voltage output to the liquid crystal panel together with those of a comparative example.

FIG. 12 illustrates a response characteristic of the liquid crystal display device 30 of the present embodiment (solid line). FIG. 12 also illustrates a response characteristic of a comparative example (broken line) where the overshoot driving operation is not performed. In the present embodiment, the pulse rate of the signal that is input to the liquid crystal panel 20 is doubled as compared with that of the comparative example. In the third field, the signal level changes rapidly, whereby the signal is overshot (the overshoot amount is shown in the figure) to apply a high-voltage side overshoot driving voltage. Thus, a signal in which high-voltage side is emphasized is input to the liquid crystal panel 20 in the third field. As a result, the optical response characteristic I(t) is improved, as shown by the solid line, as compared with that in a case where the overshoot driving operation is not performed (i.e., a case where a voltage within the gray level voltage range, in response to which the same steady transmittance value is reached, is applied).

Embodiment 2

A liquid crystal display device of Embodiment 2 is an NB-mode liquid crystal display device including a horizontal-alignment-type liquid crystal layer. The liquid crystal display device includes the liquid crystal panel 100 illustrated in FIG. 10 and the driving circuit 10 illustrated in FIG. 4A.

The TFT substrate and the CF substrate of the TFT-type liquid crystal panel 100 are produced by a known method. An alignment film is formed on the surface of each of the substrates. Each picture element region on the surface of the alignment film is divided into two regions A and B, after which the surface of the alignment film is irradiated with UV light (ultraviolet rays). In the region A, the alignment film of the CF substrate is irradiated with UV light, whereas in the region B, the alignment film of the TFT substrate is irradiated with UV light. Then, the surface of each alignment film is rubbed in one direction. The TFT substrate and the CF substrate are attached to each other so that the rubbing directions are parallel to each other, after which a nematic liquid crystal material where $\Delta\in>0$ is injected into the gap therebetween, thereby obtaining a liquid crystal cell.

Figure 13A:
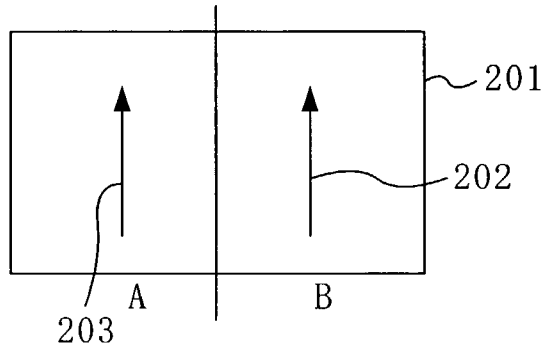
FIG. 13A to FIG. 13C are diagrams illustrating the orientation of liquid crystal molecules in a liquid crystal layer of a liquid crystal display device of Embodiment 2 of the present invention.
Figure 13B:
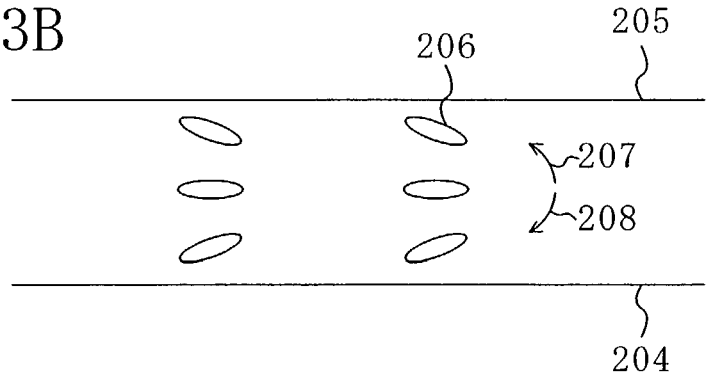
Figure 13C:
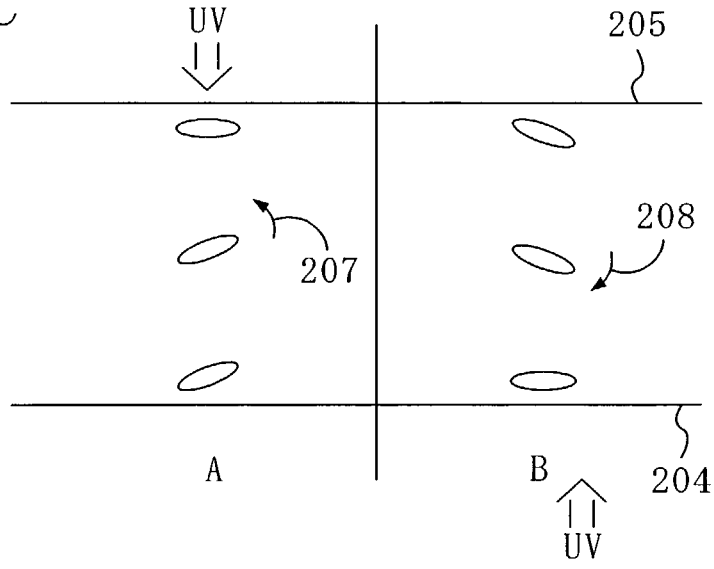
Figure 14:
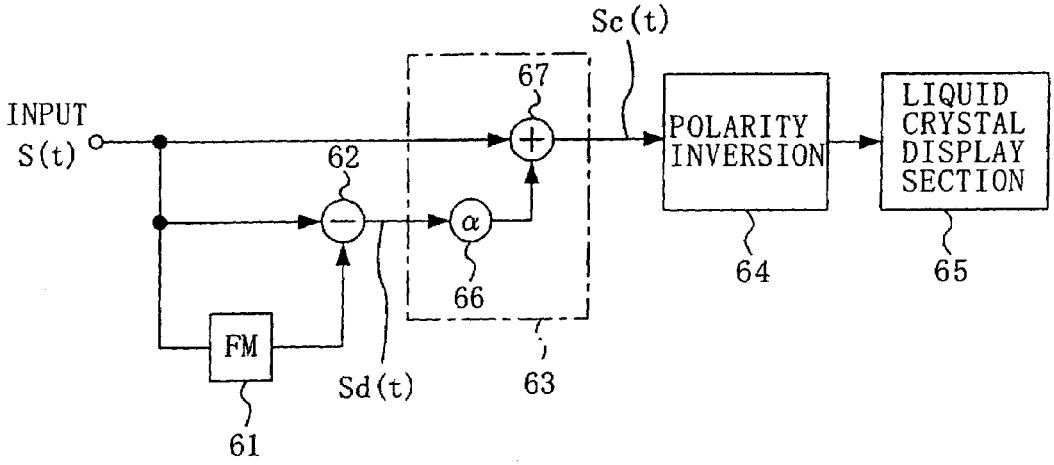
FIG. 14 PRIOR ART
FIG. 14 is a schematic diagram illustrating a configuration of a driving circuit of a conventional liquid crystal display device.
Figure 15:
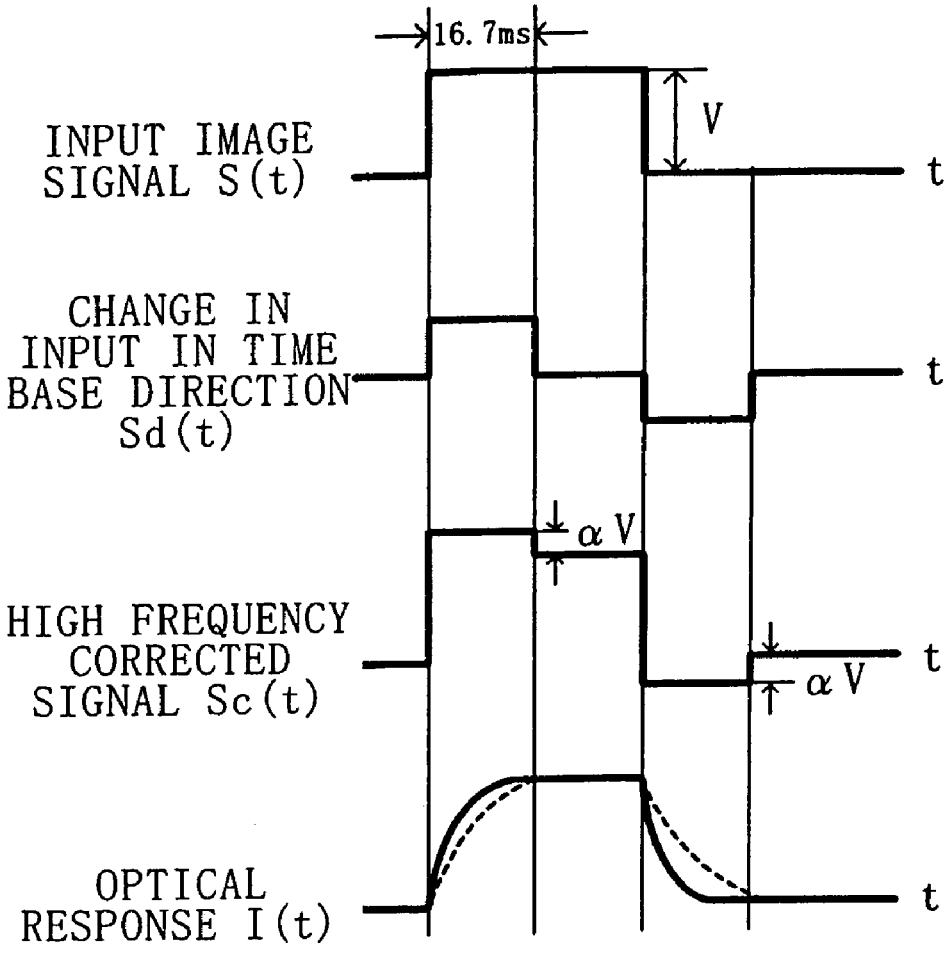
FIG. 15 PRIOR ART
FIG. 15 is a signal waveform diagram illustrating how the response characteristic is improved by the driving circuit illustrated in FIG. 14.

The orientation of the liquid crystal molecules in the liquid crystal cell will now be described with reference to FIG. 13A to FIG. 13C. FIG. 13A shows that rubbing directions 202 and 203 of the two regions A and B in one picture element 201 are the same. If the alignment layers are not irradiated with UV light as described above, liquid crystal molecules 206 substantially in the middle layer of the liquid crystal layer are oriented substantially parallel to the substrate surface in the absence of an applied voltage, as illustrated in FIG. 13B. When a voltage is applied across the liquid crystal layer, the liquid crystal molecules 206 in the middle layer rise in either one of two directions indicated by arrows 207 and 208 with the same probability. In the present embodiment, however, an alignment film 205 in the region A and an alignment film 204 in the region B are irradiated with UV light, whereby the pretilt angle is decreased on the UV-irradiated portion of each alignment film. As a result, the liquid crystal molecule substantially in the middle layer of the liquid crystal layer in the region A rotate in the direction indicated by the arrow 207, whereas the liquid crystal molecule substantially in the middle layer of the liquid crystal layer in the region B rotate in the direction indicated by the arrow 208, as illustrated in FIG. 13C. Thus, the orientation of the liquid crystal molecules is controlled so that the direction in which a liquid crystal molecule in or near the middle layer of the liquid crystal layer is pretilted in the region A is different from that in the region B by 180°. With the liquid crystal layer having such an orientation, the viewing angle dependence in the region A and that in the region B are compensated for by each other, thereby resulting in desirable viewing angle characteristics. Note that while a liquid crystal layer having such an orientation as described above is preferred, the viewing angle characteristics can be improved by using any liquid crystal layer having two or more regions in which the liquid crystal molecules are oriented differently.

Phase plates and polarizing plates are attached to the obtained liquid crystal cell, as illustrated in FIG. 10, thereby obtaining the liquid crystal panel 100.

The orientation parameters of the regions A and B are as shown in Table 1 below.

TABLE 1

| Region | Area proportion in picture element | Retardation value | Twist angle | Orientation direction |
|---|---|---|---|---|
| A | 50% | 240 nm | 0 deg | 0 deg |
| B | 50% | 240 nm | 0 deg | 180 deg |

The parameters of the polarizing plates 108 and 109 are as shown in Table 2 below. Note that the angle of the transmission axis of each of the polarizing plates 108 and 109 is an angle with respect to the orientation direction of liquid crystal molecules.

TABLE 2

| Reference numeral of polarizing plate | Angle of transmission axis |
|---|---|
| 108 | 45 deg |
| 109 | −45 deg |

The parameters of the phase plates 102 to 105, 110 and 111 are as shown in Table 3 below, where na, nb and nc are the three principal refractive indices of the refractivae index ellipsoid of the phase plate, d is the thickness of the phase plate, d·(na−nb) is the retardation in a plane parallel to the display surface of the liquid crystal panel 100, and d·(na−nc) is the retardation in the thickness direction. The angle of the na axis is an angle with respect to the orientation direction of liquid crystal molecules.

TABLE 3

| Reference numeral of phase plate | d · (na − nb) | d · (na − nc) | Angle of na axis |
|---|---|---|---|
| 102 | 120 nm | 0 nm | 90 deg |
| 103 | 120 nm | 0 nm | 90 deg |
| 104 | 0 nm | −120 nm | 90 deg |
| 105 | 0 nm | −120 nm | 90 deg |
| 110 | 25 nm | 0 nm | −45 deg |
| 111 | 25 nm | 0 nm | 45 deg |

The liquid crystal panel 100 includes, for each picture element, the region A and the region B in which the liquid crystal molecules are oriented in different directions, and the viewing angle characteristics are compensated for by the phase plates, thereby resulting in a wide viewing angle.

The driving circuit 10 is as described above in Embodiment 1, and will not be further described below.

In the liquid crystal display device of the present embodiment, the transmittance is lowest when the applied voltage is zero or near zero, and gradually increases as the applied voltage is increased. Thus, the liquid crystal display device is an NB-mode liquid crystal display device.

Note that the embodiments of the present invention have been described above with respect to a liquid crystal display device that operates in an interlaced mode, in which one field corresponds to one vertical period. However, the present invention is not limited thereto, but may alternatively be used with a liquid crystal display device that operates in a non-interlaced mode, in which one frame corresponds to one vertical period.

The present invention provides a liquid crystal display device in which the rising response speed is improved. The liquid crystal display device of the present invention, having a high response speed, is capable of preventing the image from being blurred due to the after-image phenomenon in motion picture display, thereby displaying a motion picture with a high quality.

While the present invention has been described in preferred embodiments, it will be apparent to those skilled in the art that the disclosed invention may be modified in numerous ways and may assume many embodiments other than those specifically set out and described above. Accordingly, it is intended by the appended claims to cover all modifications of the invention that fall within the true spirit and scope of the invention.

What is claimed is:

1. A liquid crystal display device, comprising:

a liquid crystal panel including a liquid crystal layer and an electrode for applying a voltage across the liquid crystal layer; and a driving circuit for supplying a driving voltage to the liquid crystal panel, wherein:

the liquid crystal panel exhibits a local maximum value of transmittance in a voltage-transmittance characteristic in response to a voltage that is equal to or greater than a highest gray level voltage;

the driving circuit supplies, to the liquid crystal panel, a predetermined driving voltage that is obtained by overshooting a gray level voltage corresponding to an input image signal of a current vertical period according to a combination of an input image signal of a previous vertical period and the input image signal of the current vertical period; and a difference between a retardation of the liquid crystal panel under application of no voltage and that under application of a maximum voltage that can be applied across the liquid crystal panel is 280 nm or more.

2. The liquid crystal display device of claim 1, wherein the input image signal of the previous vertical period is processed according to an estimate value of transmittance of the liquid crystal panel in the previous vertical period.

3. The liquid crystal display device of claim 1, wherein the liquid crystal panel takes a retardation value of 260 nm or more in response to a voltage that is equal to or greater than a highest gray level voltage and is less than or equal to a maximum voltage that can be applied across the liquid crystal panel.

4. The liquid crystal display device of claim 1, wherein the liquid crystal panel is a transmission-type liquid crystal panel and the extreme value gives a maximum value of transmittance.

5. The liquid crystal display device of claim 1, wherein the driving circuit supplies, to the liquid crystal panel, a driving voltage that is obtained by overshooting a gray level voltage corresponding to an input image signal of a current field, at least in first one of at least two fields of the driving voltage, the at least two fields of the driving voltage corresponding to one frame of the input image signal, and the one frame being one vertical period of the input image signal.

6. The liquid crystal display device of claim 1, wherein the liquid crystal layer is a vertical-alignment-type liquid crystal layer.

7. The liquid crystal display device of claim 1, wherein:

the liquid crystal panel further includes a phase difference compensator; and the phase difference compensator has a refractive index ellipsoid whose three principal refractive indices na, nb and nc are in a relationship of na=nb>nc, and is arranged so as to at least partially cancel a retardation of the liquid crystal layer.

8. The liquid crystal display device of claim 1, wherein:

the liquid crystal panel further includes a phase difference compensator; and the phase difference compensator has a refractive index ellipsoid whose three principal refractive indices na, nb and nc are in relationships of na>nc and nb>nc, and is arranged so as to at least partially cancel a retardation of the liquid crystal layer.

9. A liquid crystal display device, comprising:

a liquid crystal panel including a liquid crystal layer and an electrode for applying a voltage across the liquid crystal layer; and a driving circuit for supplying a driving voltage to the liquid crystal panel, wherein:

the liquid crystal panel exhibits an extreme value of transmittance in a voltage-transmittance characteristic in response to a voltage that is equal to or greater than a highest gray level voltage;

the driving circuit supplies, to the liquid crystal panel, a predetermined driving voltage that is obtained by overshooting a gray level voltage corresponding to an input image signal of a current vertical period according to a combination of an estimate signal corresponding to an estimate value of transmittance of the liquid crystal panel in a previous vertical period and the input image signal of the current vertical period; and a difference between a retardation of the liquid crystal panel under application of no voltage and that under application of a maximum voltage that can be applied across the liquid crystal panel is 280 nm or more.

10. The liquid crystal display device of claim 9, wherein the estimate signal in the previous vertical period is predetermined according to a combination of an estimate signal, which has been processed according to an estimate value of transmittance of the liquid crystal panel in a vertical period preceding the previous vertical period, and an input image signal of the previous vertical period.

11. The liquid crystal display device of claim 9, wherein the estimate signal in the previous vertical period corresponds to a transmittance of the liquid crystal panel in the current vertical period.

12. A liquid crystal display device, comprising:

a liquid crystal panel adapted to exhibit a local maximum value of transmittance in a voltage-transmittance characteristic in response to a voltage that is equal to or greater than a highest gray level voltage; and a driving circuit adapted to supply, to the liquid crystal panel, a driving voltage obtained by overshooting a gray level voltage corresponding to an input image signal of a current vertical period based on a combination of an input image signal of a previous vertical period and the input image signal of the current vertical period.

* * * * *